US012503257B2

(12) United States Patent
Koontz

(10) Patent No.: US 12,503,257 B2
(45) Date of Patent: Dec. 23, 2025

(54) METHOD TO FILL A CONTAINER

(71) Applicant: Curtis S. Koontz, Signal Mountain, TN (US)

(72) Inventor: Curtis S. Koontz, Signal Mountain, TN (US)

( * ) Notice: Subject to any disclaimer, the term of this patent is extended or adjusted under 35 U.S.C. 154(b) by 37 days.

(21) Appl. No.: 18/436,590

(22) Filed: Feb. 8, 2024

(65) Prior Publication Data

US 2024/0228080 A1 Jul. 11, 2024

Related U.S. Application Data

(63) Continuation-in-part of application No. 17/684,609, filed on Mar. 2, 2022, now abandoned.

(60) Provisional application No. 63/156,041, filed on Mar. 3, 2021.

(51) Int. Cl.

| | |
|---|---|
| ***A23B 4/052*** | (2006.01) |
| ***B65B 1/06*** | (2006.01) |
| ***B65B 7/28*** | (2006.01) |
| ***B65B 37/02*** | (2006.01) |
| ***B65B 43/54*** | (2006.01) |
| ***B65B 61/00*** | (2006.01) |

(52) U.S. Cl.

CPC ..... *B65B 1/06* (2013.01); *B65B 7/2857* (2013.01); *B65B 37/02* (2013.01); *B65B 43/54* (2013.01); *B65B 61/00* (2013.01)

(58) Field of Classification Search

CPC ..... B65D 17/4012; B65D 2517/0014; B65D 1/165; B65B 7/2857; B65B 31/028; B21D 51/38; A23B 4/0523

See application file for complete search history.

(56) References Cited

U.S. PATENT DOCUMENTS

| | | | | | |
|---|---|---|---|---|---|
| 2,967,023 | A * | 1/1961 | Huckabee | A47J 37/0704 | 126/369 |
| 3,934,749 | A * | 1/1976 | Andrulionis | B32B 27/288 | 229/125.05 |
| 4,779,525 | A * | 10/1988 | Gaines | A23B 4/0523 | 206/525 |
| 5,048,406 | A * | 9/1991 | Cofer | A23B 4/0523 | 206/525 |
| 5,054,265 | A * | 10/1991 | Perigo | B21D 51/32 | 53/425 |
| 5,617,705 | A * | 4/1997 | Sanfilippo | B65B 31/028 | 53/489 |

(Continued)

*Primary Examiner* — Andrew M Tecco

(74) *Attorney, Agent, or Firm* — K&L Gates LLP

(57) ABSTRACT

Disclosed is a method to fill and seal a container for smoking food on a grill. The method includes positioning a container on a conveyor system, receiving the container in a vent hole applicator system, and placing a vent hole in the container with the vent hole applicator system. The method further includes receiving the container in a filling system, positioning the container adjacent to a tube from the filling system, and dispensing a smoke fuel from a hopper into the container through the tube. The method further includes receiving the container in a seam sealing system, positioning a lid onto the container, and curling the lid and container top to form a double seam. The method further includes receiving the container in a packaging system and packaging the container into sale packs for distribution.

19 Claims, 16 Drawing Sheets

(56) References Cited

U.S. PATENT DOCUMENTS

| | | | | | |
|---|---|---|---|---|---|
| 5,687,551 | A * | 11/1997 | Mustain | B65B 43/60 | 141/10 |
| 6,059,849 | A * | 5/2000 | Lewis | A23B 4/0526 | 44/590 |
| 6,481,344 | B1 * | 11/2002 | Green | A23B 4/052 | 99/482 |
| 6,588,173 | B1 * | 7/2003 | Moore | B65B 59/001 | 53/201 |
| 6,666,933 | B2 * | 12/2003 | Roberts | B21D 51/38 | 148/692 |
| 7,415,428 | B2 * | 8/2008 | Garwood | B65D 21/062 | 705/26.5 |
| 10,195,657 | B1 * | 2/2019 | Head | B21D 51/2661 | |
| 11,117,696 | B2 * | 9/2021 | Scott | B65B 31/044 | |
| 11,661,221 | B2 * | 5/2023 | Scott | B65B 31/028 | 53/510 |
| 2004/0094559 | A1 * | 5/2004 | Santamaria | B21D 51/38 | 220/608 |
| 2007/0084149 | A1 * | 4/2007 | Jorissen | B65B 61/207 | 53/471 |
| 2015/0136630 | A1 * | 5/2015 | Miller, Jr. | B65D 21/022 | 206/509 |
| 2016/0039563 | A1 * | 2/2016 | Dunwoody | B65D 1/165 | 220/269 |
| 2019/0177017 | A1 * | 6/2019 | Scott | B65B 31/028 | |

* cited by examiner

METHOD TO FILL A CONTAINER

CROSS-REFERENCE TO RELATED APPLICATION

This application which is a continuation-in-part application claiming priority under 35 U.S.C. § 120 to U.S. patent application Ser. No. 17/684,609, entitled METHOD TO FILL A CONTAINER filed on Mar. 2, 2022, which claims the benefit of priority under 35 U.S.C. § 119 (e) to U.S. Provisional Patent Application Ser. No. 63/156,041, entitled METHOD TO FILL A CONTAINER, filed Mar. 3, 2021, the entire disclosures of each are hereby incorporated by reference here in their respective entireties.

BACKGROUND

The present disclosure relates to a container for use with any dry non-liquid material such as a smoke fuel to smoke food on a grill. Barbecuing or smoke-roasting is a process that simultaneously cooks and smokes a desired food, such as meat or fish. Wood smoke, depending on the type of wood, imparts a particular flavor and aroma to the food. Some woods impart a mild flavor, such as alder, apple, cherry, and maple. Others add a fuller, medium flavor, such as hickory, pecan and oak. Stronger flavors come from walnut, grapevine, and mesquite woods. There are various types of smokers that are used to smoke-roast food, including propane, charcoal, offset, pellet, electric, Kamado, and kettle type grills. Of these types, some are exclusively used to only smoke food and can be considerably expensive. The wood used in these smokers or grills can come in various configurations, such as split wood, wood chips, or wood pellets.

SUMMARY

In one general aspect, the present disclosure provides a method to fill and seal a container for smoking food on a grill. The method includes positioning a container on a conveyor system, receiving the container in a vent hole applicator system, and placing a vent hole in the container with the vent hole applicator system. The method further includes receiving the container in a filling system, positioning the container adjacent to a tube from the filling system, and dispensing a smoke fuel from a hopper into the container through the tube. The method further includes receiving the container in a seam sealing system, positioning a lid onto the container, and curling the lid and container top to form a double seam. The method further includes receiving the container in a packaging system and packaging the container into sale packs for distribution.

In another general aspect, the present disclosure provides a method to fill and seal a container. The method includes positioning a container on a conveyor system, receiving the container in a vent hole applicator system, and placing a vent hole in the container with the vent hole applicator system. The method further includes receiving the container in a filling system, positioning the container adjacent to a tube from the filling system, and dispensing a dry material from a hopper into the container through the tube. The method further includes receiving the container in a seam sealing system, positioning a lid onto the container, and curling the lid and container top to form a double seam. The method further includes receiving the container in a packaging system, and packaging the container into sale packs for distribution.

BRIEF DESCRIPTION OF THE FIGURES

The novel features of the various aspects are set forth with particularity in the appended claims. The described aspects, however, both as to organization and methods of operation, may be best understood by reference to the following description, taken in conjunction with the accompanying drawings. The accompanying drawings are not intended to be drawn to scale. In the drawings:

DESCRIPTION

Figure 1:
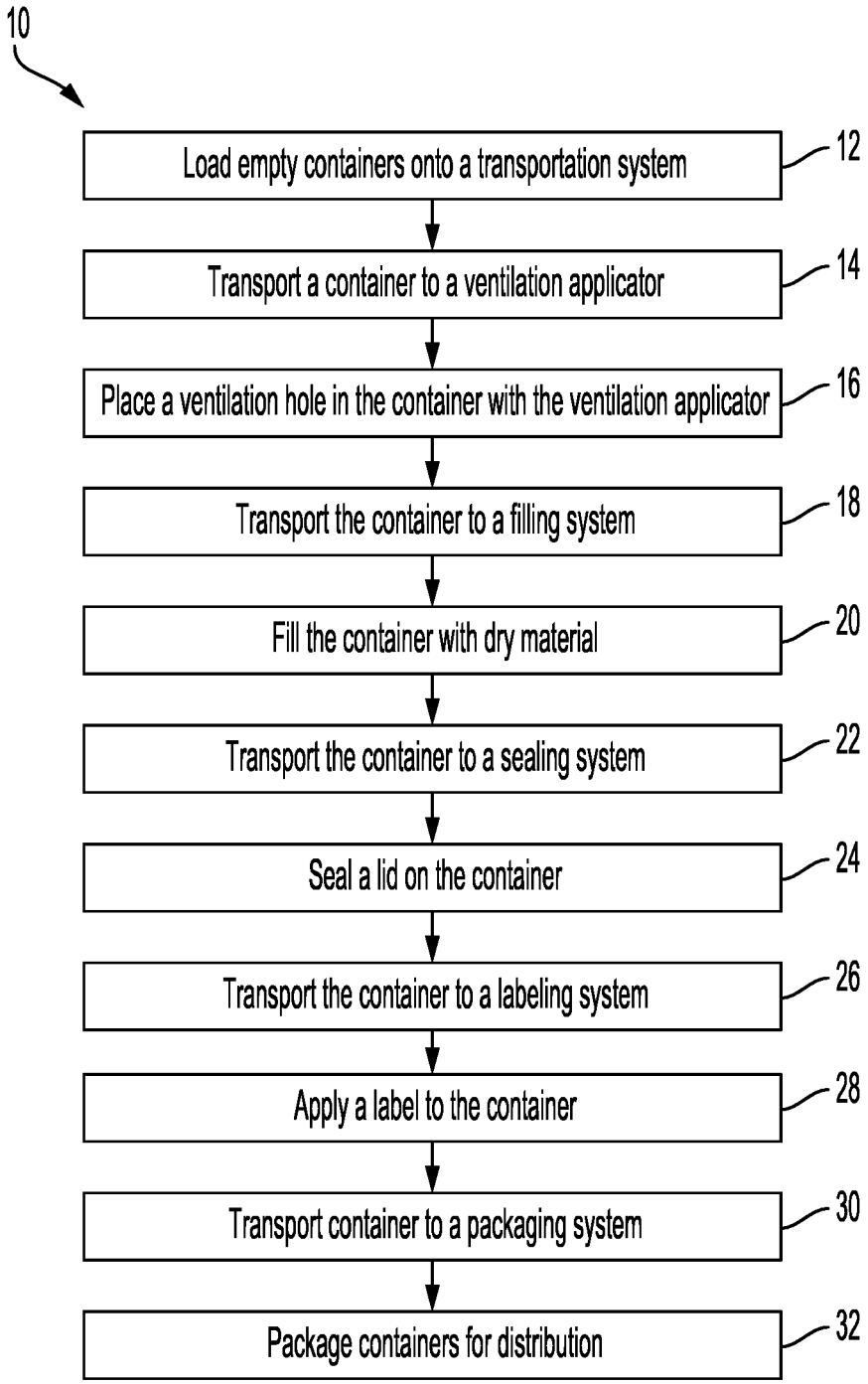
FIG. 1 illustrates an example method to fill a container with a dry material and package it, according to at least one aspect of the present disclosure.

It is to be understood that the following disclosure provides many different embodiments, or examples, for implementing different features of the disclosure. Specific embodiments or examples of components and arrangements are described below to simplify the present disclosure. These are, of course, merely examples and are not intended to be limiting. For example, dimensions of elements are not limited to the disclosed range or values, but may depend upon process conditions and/or desired properties of the device. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Various features may be arbitrarily drawn in different scales for simplicity and clarity.

Further, spatially relative terms, such as "beneath," "below," "lower," "above," "upper" and the like, may be used herein for ease of description to describe one element or feature's relationship to another element(s) or feature(s) as illustrated in the figures. The device may be otherwise oriented (rotated 90 degrees or at other orientations) and the spatially relative descriptors used herein may likewise be interpreted accordingly. In addition, the term "made of" may mean either "comprising" or "consisting of."

Barbecuing or smoke-roasting is a process that simultaneously cooks and smokes a desired food, such as meat or fish. There are various types of smokers that are used to smoke-roast food, including propane, charcoal, offset, pellet, electric, Kamado, and kettle type grills. Of these types, some are exclusively used to only smoke food and can be considerably expensive. The wood used in these smokers or grills can come in various configurations, such as split wood, wood chips, or wood pellets. Using split wood to smoke food requires a large smoker and is only used by experienced grill masters. More convenient sources of smoke fuels are wood chips and wood pellets. To use these, however, requires some container within the grill that needs to be cleaned and refilled each time the person uses the grill.

In various aspects, the present disclosure provides a prefilled smoke container that can be used on a conventional grill to smoke food. In at least one aspect, the smoke container is a 12 oz. can, similar to a beer or soda can, filled with a smoke fuel, such as wood chips or pellets. The smoke container may be filled with a single type of wood, e.g. mesquite, or a combination of woods such as apple and pecan. The smoke containers can be marketed and sold as individual cans, 4 packs, or 6 packs. The smoke containers can be packaged into any desired pack size.

The smoke container is simple to use. In one aspect, the container includes a top lid. The top lid can include an easy open tab as known in the art such as a lid of a can of soda or beer and can be configured to be opened in the usual manner. In at least one aspect, the container can be configured to have a vent hole created on an end of the container opposite of the top lid. In at least one alternative aspect, the container has a vent hole on a side of the container. In one aspect, the vent hole may be created with a knife, screwdriver, or similar device. In an alternative aspect, the vent hole is placed into the container with a vent hole applicator system and the container is sold with the vent hole in the container. The smoke container is laid on a grill grate or coals horizontally with the vent hole pointing upwards. The grill may be preheated (around 400° F.) to allow the smoke container to begin smoking. Once the smoke container begins to emit smoke, the food can be cooked to its desired condition. Multiple smoke containers can be used to impart a stronger smoke flavor. Once the cooking/smoking process has been completed, the smoke container, after cooling down, can be disposed of appropriately.

The smoke container is simple to use for novice grillers as well as experienced grillers. It does not require any cleaning of the grill or refilling of the smoke container after being used. The smoke container is a single use implement that allows food to be smoked while the food is grilled on a conventional grill that many people already own. The smoke container allows food to be smoked without requiring an expensive smoker.

In various aspects, the present disclosure provides a method to fill a container with a dry material, such as smoke fuel. The filled smoke container may be used on any grill to smoke food that is being grilled. FIG. 1 illustrates a method 10 to fill a container with a dry material and package it, according to at least one aspect of the present disclosure. The method 10 includes loading 12 empty containers onto a transport system. In at least one aspect, the empty containers are loaded onto a depalletizer (e.g. depalletizer 200, FIG. 2). The depalletizer can unload the empty containers onto a transport system (e.g. conveyor system 220, FIG. 2). Stated another way the depalletizer can unload the empty containers and position them onto a conveyor system that transports each container to and from different systems for filling, sealing, packaging, etc. In at least one aspect, each system that receives a container includes a conveyor or transport system to move the container through the system and toward the next. In an alternative aspect, the different systems can be positioned next to a conveyor that moves the containers to and through each system. The transport system can be a single conveyor, multiple conveyors, or any other system that can transport the empty containers.

Figure 2:
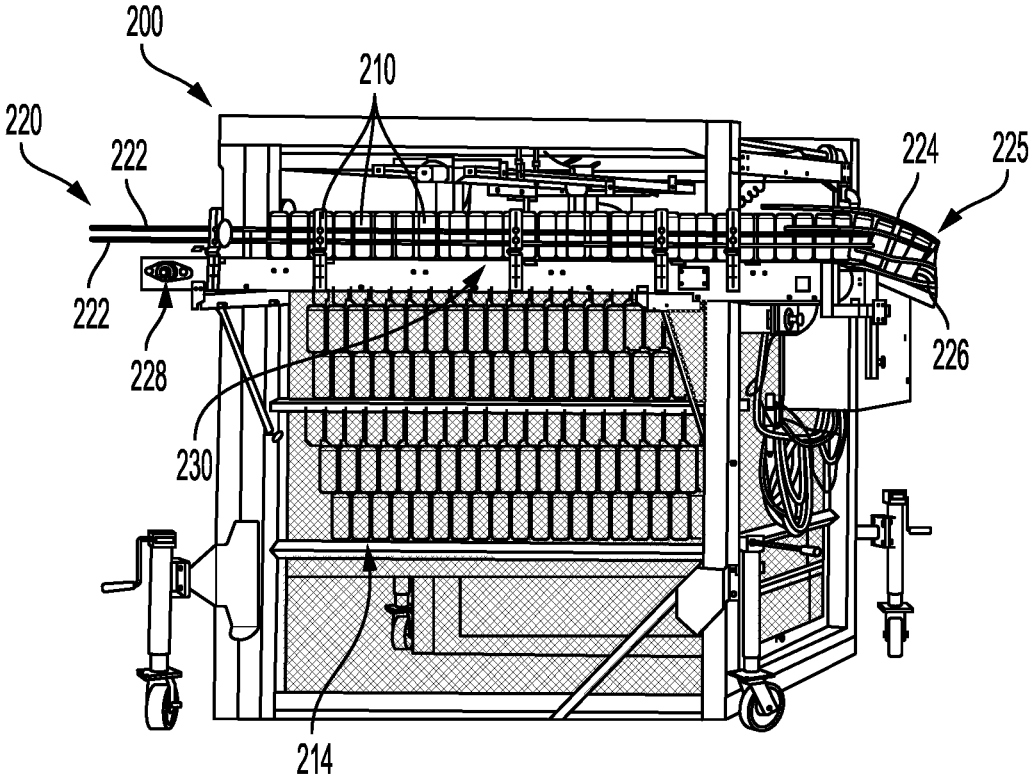
FIG. 2 illustrates an example depalletizer, according to at least one aspect of the present disclosure.
Figure 3:
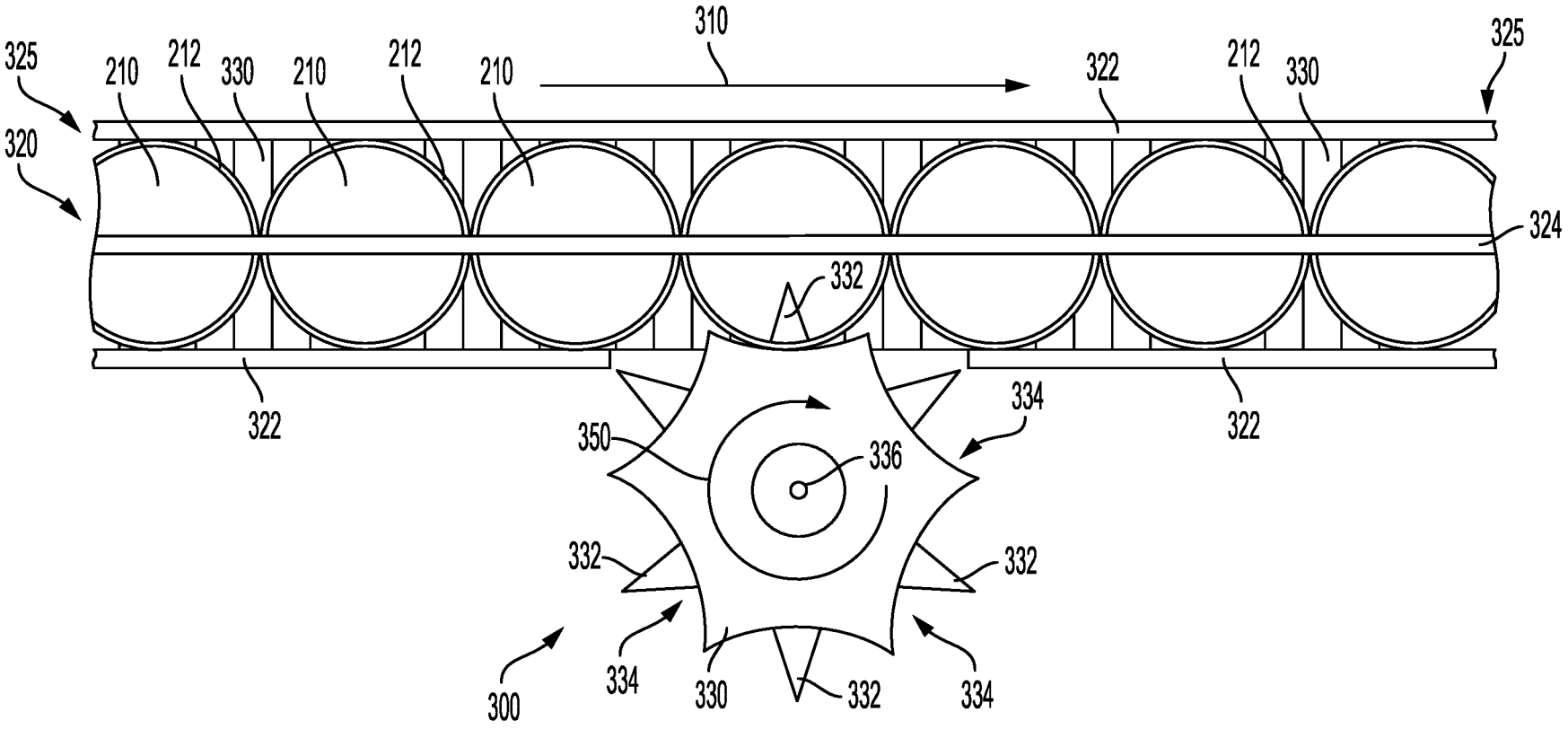
FIG. 3 illustrates a top view of an example ventilation applicator, according to at least one aspect of the present disclosure.
Figure 4:
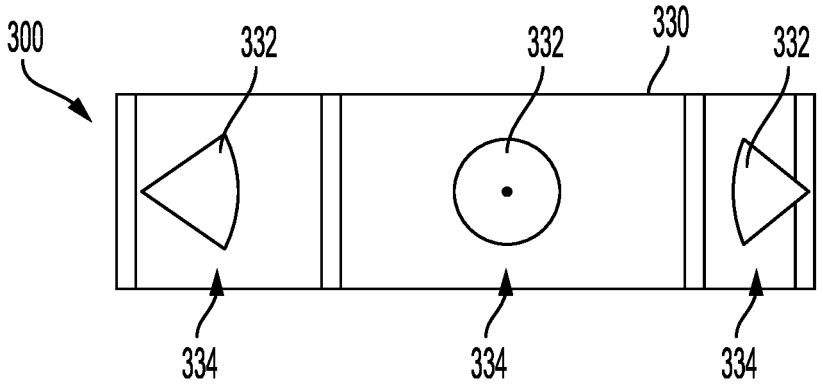
FIG. 4 illustrates a side view of the ventilation applicator of FIG. 3, according to at least one aspect of the present disclosure.

The method 10 includes transporting 14 an empty container to a ventilation applicator (e.g. ventilation applicator 300, FIGS. 3 and 4). In at least one aspect, empty containers are transported to the ventilation applicator by a rail system (e.g. rail system 225, FIG. 2). For example, a container can be placed on a conveyor from a depalletizer and the conveyor can move empty container to a rail system, where the container can slide on the rail to the ventilation applicator. The rail system can be considered as part of the conveyor. In at least one aspect, the containers are moved by the conveyor and push the containers in front on rails through the rail system. In an alternative aspect, gravity moves the containers through the rail system. In at least one alternative aspect, the container is transported to the ventilation applicator by a conveyor where the container moves from the conveyor of the depalletizer to the conveyor of the ventilation applicator.

The method 10 further includes placing 16 a ventilation hole in the container with the ventilation applicator. In at least one aspect, the empty container enters the ventilation applicator. The container moves on a conveyor of the ventilation applicator into a position where the ventilation applicator can apply a ventilation hole to the container. In at least one aspect, the ventilation hole is pushed into a side of the container. In an alternative aspect, the ventilation hole is cut into the side of the container. In yet another alternative aspect, the ventilation hole is drilled into the side of the container. In at least one aspect, the ventilation hole has a size of 0.125 to 0.5 inches. Once the ventilation hole is applied, the conveyor moves the container away from the ventilation applicator.

The method 10 further includes transporting 18 the container to a filling system (e.g. filling system 400). In at least one aspect, the conveyor of the ventilation applicator is positioned next to a conveyor of the filling system. For example, the container moves from the conveyor of the ventilation applicator to the conveyor of the filling system. In at least one aspect, a rail system is used to guide the containers on the conveyors as the container moves from the ventilation applicator to the filling system. In an alternative aspect, a rail system is positioned between the conveyors of the ventilation applicator and filling system. In either case, the container moves from a conveyor of the ventilation applicator to a conveyor of the filling system.

The method 10 further includes filling 20 the container with a dry material. In at least one aspect, the dry material is a smoke fuel. The container moves on the conveyor of the filling system into a position where the filling system can fill the container with a dry material, as discussed in regard to FIGS. 6-7C. A dry material can include any dry, non-liquid material. In one aspect, a dry material can include a smoke fuel, such as wood chips, wood pellets, and/or any type of pellet fuel such as pellet biofuels. In another aspect, a dry material can include a dried food good such as baker's yeast, dehydrated bouillon, freeze-dried goods, dried fruit, powdered food, instant coffee, coffee beans, coffee grounds, spices, oatmeal, soup stock, seeds, beans, grain, dried meat, dried seafood, and/or candy. In another aspect, a dry material can include a *cannabis* and/or tobacco product. In yet another aspect, a dry material can include any material that exists as a powder, granule, pellet, briquette, pill, tablet, capsule, bead, or similar form.

The method 10 further includes transporting 22 the container to a sealing system (e.g. sealing system 500). In at least one aspect, the conveyor of the filling system is positioned next to a conveyor of the sealing system. For example, the container moves from the conveyor of the filling system to the conveyor of the sealing system. In at least one aspect, a rail system is used to guide the containers on the conveyors as the container moves from the filling system to the sealing system. In at least one aspect, the filling system conveyor and the sealing system conveyor are the same conveyor. In an alternative aspect, a rail system is positioned between the conveyors of the filling system and sealing system.

The method 10 further includes sealing 24 a lid on the container. In at least one aspect, a lid is positioned on the container as the lid moves through the sealing system. For example, a lid can be positioned on the container from a lid dispenser (e.g. lid dispenser 510, FIG. 8). The container moves on the conveyor of the sealing system into a position where the sealing system can seal the lid onto the container as discussed in regard to FIGS. 8-10C. In at least one aspect, the lid may be double seam sealed to the filled container. In at least one aspect, the lid is an easy to open lid with a stay on tab, such as those seen on a beer or soda can.

In at least one aspect, the method 10 further includes cleaning the container with a cleaning system (e.g. cleaning system 550). For example, the sealed container may be moved through a cleaning system by a conveyor, where the cleaning system sprays water on the container to clean the container of any debris. In at least one aspect, the sprayed water cools the container. In at least one aspect, the cleaning system can be part of the sealing system and use the same conveyor. In an alternative aspect, sealing system can have its own conveyor separate from a conveyor of the cleaning system. In yet another aspect, the method 10 may not have a cleaning system and as such may not perform a cleaning operation.

The method 10 further includes transporting 26 the container to a labeling system (e.g. labeling system 600). In at least one aspect, the conveyor of the sealing and/or cleaning system is positioned next to a conveyor of the labeling system. For example, the container moves from the conveyor of the sealing system and/or cleaning system to the conveyor of the labeling system. In at least one aspect, a rail system is used to guide the containers on the conveyors as the container moves from the sealing system to the labeling system. In at least one aspect, the sealing system conveyor and the labeling system conveyor are the same conveyor. In an alternative aspect, a rail system is positioned between the conveyors of the sealing system and labeling system.

The method 10 further includes applying 28 a label to the container. The container moves through the labeling system on the conveyor of the labeling system and a label is applied to the container from a media supply. For example, the container can be rotated as the container moves through the labeling system and a label from a media supply can be positioned around the container, as discussed in regard to FIG. 11.

The method 10 further includes transporting 30 the container to a packaging system (e.g. packaging system 700). In at least one aspect, the conveyor of the labeling system is positioned next to a conveyor of the packaging system. For example, the container moves from the conveyor of the labeling system to the conveyor of the packaging system. In at least one aspect, a rail system is used to guide the containers on the conveyors as the container moves from the labeling system to the packaging system. In at least one aspect, the labeling system conveyor and the packaging system conveyor are the same conveyor. In an alternative aspect, a rail system is positioned between the conveyors of the labeling system and packaging system.

The method 10 further includes packaging 32 sealed containers for distribution. In at least one aspect, the container is moved on the conveyor of the packaging system into a position along with other containers to be grouped into a carrier. For example, a predetermined number of containers can be positioned in the packaging system such that a carrier can be placed on or around the predetermined number of containers by the packaging system, as discussed in regard to FIG. 12. The containers may be packaged into different package sizes for storage, for wholesale distribution, and/or retail distribution. The package sizes can be selected based on how the containers will be sold. For example, the smoke containers can be sold individually, in 4 packs, in 6 packs, or any suitable numbers of smoke container packs convenient for purchase.

The method 10 of FIG. 1 illustrates one non-limiting example for the order of operations to fill a container. However, there or other examples for the order of operations. The method 10 depalletizes the containers, places a ventilation hole in the container, fills the container, seals the container, labels the container, and then packages the container. The methods 800 (FIG. 15), 900 (FIG. 16), and 1000 (FIG. 17) discusses some different example order of operations that can be performed. The method 800 depalletizes the containers, fills the container, places a ventilation hole in the container, seals the container, labels the container, and then packages the container. The method 900 depalletizes the containers, fills the container, seals the container, places a ventilation hole in the container, labels the container, and then packages the container. The method 1000 depalletizes the containers, fills the container, seals the container, labels the container, places a ventilation hole in the container, and then packages the container. The methods 800, 900, and 1000 function substantially similarly to the method 10 with the order of operations changed and as such the order a container enters the systems also changes accordingly to match the method 10, 800, 900, or 1000.

FIG. 2 illustrates an example depalletizer 200, according to at least one aspect of the present disclosure. The depalletizer 200 includes a conveyor system 220. The depalletizer 200 takes a pallet loaded with a plurality of empty containers 214 and places each container 210 of the plurality of empty containers 214 onto a conveyor system 220. The conveyor system 220 moves each container to the next system in the line (e.g. ventilation applicator 300 or filling system 400 depending on the method 10, 800, 900, or 1000). The conveyor system 220 includes a conveyor 230 and a rail system 225 to keep the containers upright on the conveyor 230. The rails system 225 includes side rails 222, a top rail 224, and a bottom rail 226. The bottom rail 226 is position after the conveyor 230. In at least one aspect, the rail system 225 can extend over the conveyor 230 and after the conveyor 230. For example, the side rails 222 and the top rail 224 can extend over the conveyor to keep the containers 210 upright and the bottom rail 226 extends after the conveyor. In some aspects, the rail system 225 can extend after the conveyor 230 to move the containers 222 to the next system (e.g. ventilation applicator 300 or filling system 400 depending on the method 10, 800, 900, or 1000). In some aspects, the conveyor 230 can be positioned adjacent a conveyor of the next system and not have a rail system between the depalletizer and the next system.

Figure 18:
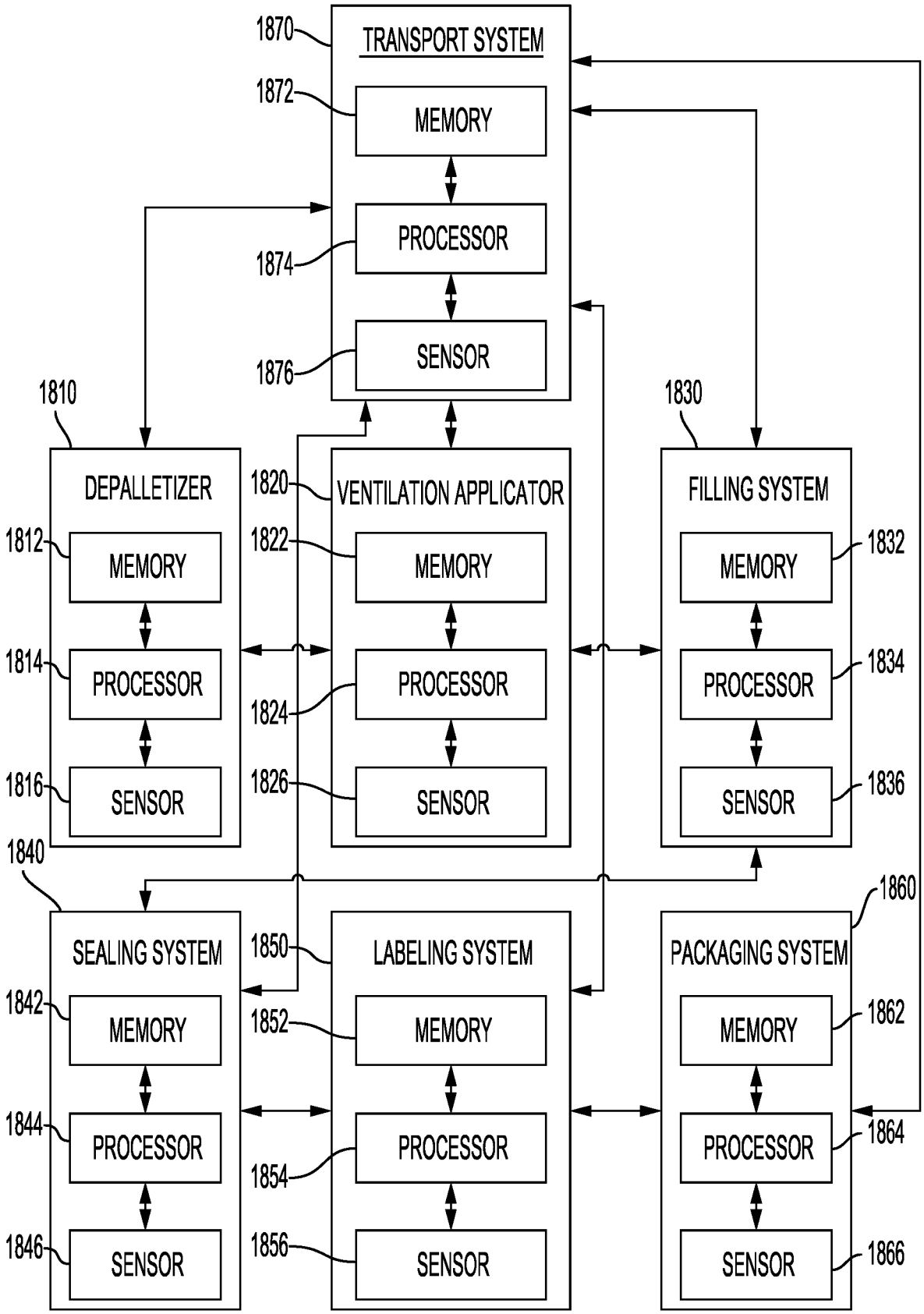
FIG. 18 illustrates a block diagram of system control circuits that may be used in aspects, according to at least one aspect of the present disclosure.

As shown in FIG. 18, in at least one aspect, the depalletizer 200 can include a depalletizer control circuit 1810 comprising at least one of a memory 1812, a processor 1814, and a sensor 1816. The sensor 1816 can measure data indicative of the position of the pallet loaded with the plurality of empty containers 214. In other aspects, the sensor 1816 can measure data indicative of the position of each of the empty containers 214 as they are placed on the conveyer system 200. The sensor 1816 may comprise proximity sensor to, for example, measure a location of an empty container 214 or a pallet. Alternatively, the sensor 1816 may comprise a switch to, for example, count the number of empty containers placed on the conveyer system 200. The depalletizer control circuit 1810 can receive a signal from the sensor 1816 and can detect when the pallet has been emptied and/or when the containers 214 have been placed on the conveyer system 200. The processor 1814 may execute instructions stored in the memory 1812 upon the receipt of the signal from the sensor 1816. Upon execution of the instructions, the depalletizer control circuit 1810 can communicate with a central control circuit or a separate system control circuit, such as the transport system control circuit 1870, to automate the next step in the method. For example, upon detection of an empty container 214 being placed on the conveyer system 200, the depalletizer control circuit 1810 can communicate with the transport system control circuit 1870 to move the empty containers 214 to the next process system.

In at least one aspect, the conveyor 230 includes a conveyor belt that wraps around rod 228. In at least one aspect, the conveyor belt is controlled by a motor with the motor rotating in one direction to move the containers down the line and rotating in another direction to move the containers back up the line.

In at least one aspect, the depalletizer 200 is one example standard depalletizer for removing container from a grouping of containers. Any other depalletizer can be used in place of depalletizer 200. For example, the reader will readily appreciate that there are a number of depalletizer that are commonly known that can be used to place a container onto a conveyor from a grouping of containers.

FIG. 3 illustrates a top view of an example ventilation applicator 300 and FIG. 4 illustrates a side view of the ventilation applicator 300, according to at least one aspect of the present disclosure. The ventilation applicator 300 includes a housing 330 and a plurality of hole applicators 332. The housing 330 has a cylindrical shape with concave pockets 334 positioned circumferentially around a surface of the housing 330. The pockets 334 are adjacent to each other around the circumference of the housing 330. The concave pockets 334 are sized and shaped to allow a container to fit in the pocket 334 as a container moves past the ventilation applicator 300.

The containers are positioned on a conveyor system 325. The conveyor system 325 includes a conveyor belt 330, side rails 322, and a top rail 324. The conveyor belt 330 moves the containers 210 past the ventilation applicator 300 and positions the containers 210 such that the ventilation applicator 300 can apply a ventilation hole to the container 210. The conveyor belt 330 moves the containers 210 in the direction 310. The side rails 222 and the top rail 324 keep the containers 210 upright as the containers 210 are moved through the ventilation applicator 300. As the containers 210 move in the direction 310, the ventilation applicator 300 rotates in the direction 350 about axis 336. This allows a container 210 to enter a pocket 334 of the ventilation applicator 300. In some aspects, the ventilation applicator 300 applies the ventilation hole to the container 210 as the container 210 moves into the pocket 334 and out of the pocket 334. In an alternative aspect, the container 210 stops when the container 210 is perpendicular to the pocket 334 so that the container 210 fills the pocket 334 and rests against the side rail 322. Then ventilation applicator 300 can then apply the ventilation hole to the container 210.

In at least one aspect, the containers 210 enter the conveyor 330 from the conveyor system of the system (e.g. depalletizer 200, filling system 400, sealing system 500, or labeling system 600) before the ventilation applicator 300. The system positioned before the ventilation applicator 300 is based on the method 10, 800, 900, or 1000 being performed. For example, the conveyors of each system are coupled together and adjacent to each other such that the containers 210 can move from one system to the next.

In at least one aspect, the ventilation hole is punctured into a side of the container by the ventilation applicator 300. In an alternative aspect, the ventilation hole is cut into the side of the container by the ventilation applicator 300. In yet another alternative aspect, the ventilation hole is drilled into the side of the container by the ventilation applicator 300.

In at least one aspect, the hole applicators 332 are sharp points attached to the center of the pockets 334 and extend away from the center of the cylinder, as shown in FIGS. 3 and 4. In this aspect, the point of a hole applicator 332 punctures the side wall 212 of a container 210 as the container moves into a pocket 334 of the ventilation applicator 300. In an alternative aspect, the hole applicators 332 are spiraled and rotate about themselves to cause a drilling motion. In this aspect, the hole applicators 332 drill through the side wall 212 of a container 210 as the container 210 moves into a pocket 334 of the ventilation applicator 300.

In an alternative aspect, the hole applicators 332 can reside inside of the housing 330. The container 210 can stop in the pocket 334 as discussed above. A hole applicator 332 can then be moved out of the housing 330 and into the container 210 positioned in the pocket 334. For example, the hole applicator 332 can be attached to a servo motor that moves the hole applicator 332 out of the housing 330 and into the side of the container 210. In at least one aspect, the hole applicator 332 is a sharp point that punctures the side of the container 210. In an alternative aspect, the hole applicator 332 is a saw that cuts the side of the container 210. For example, a servo motor can move the saw out of the housing 330 and into the container 210 positioned in the pocket 334. In yet another alternative aspect, the hole applicators 332 are a drill that drills into the side wall 212 of the container 210. For example, a servo motor can move the drill out of the housing 330 and into the container 210 positioned in the pocket 334.

As shown in FIG. 18, in at least one aspect, the ventilation applicator 300 can include a ventilation applicator control circuit 1820 comprising at least one of a memory 1822, a processor 1824, and a sensor 1826. The sensor 1826 can measure data indicative of the position of the containers 210 on the conveyor system 325. In some aspects, the sensor 1826 can measure data indicative of whether the containers 210 are in the pockets 334 of the ventilation applicator 300 prior to puncturing the side wall 212 of the container 210. The sensor 1816 may comprise proximity sensor or a switch, for example. The ventilation applicator control circuit 1820 can receive a signal from the sensor 1826 and can detect when the container 210 is adequately positioned in the pocket 334. The processor 1824 may execute instructions stored in the memory 1822 upon the receipt of the signal from the sensor 1826. For example, the processor may send a signal to a motor to activate the hole applicator 332 to puncture the side wall 212 of the container 210. Upon execution of the instructions, the ventilation applicator control circuit 1820 may communicate with a central control circuit or a separate system control circuit, such as the transport system control circuit 1870, to automate the next step in the method. For example, upon detection of the creation of a ventilation hole, the ventilation applicator control circuit 1820 may communicate with the transport system control circuit 1870 to move the containers 210 to the next process system.

Figure 5:
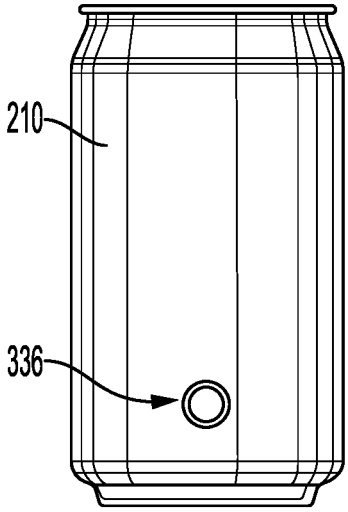
FIG. 5 illustrates a side view of a container with a ventilation hole applied by the ventilation applicator, according to at least one aspect of the present disclosure.

FIG. 5 illustrates a side view of a container 210 with a ventilation hole 336 applied by the ventilation applicator 300, according to at least one aspect of the present disclosure. While the ventilation hole 336 is shown as circular, the ventilation hole 336 could be any shape such as a rectangle, a cross, a star, etc. The ventilation hole 336 extends through the side wall 212 of the container 210. The position of the ventilation hole 336 on the container 210 is based on the vertical position of the ventilation applicator 300 relative to the container 210. For example, the ventilation hole 336 can be moved up or down the container 210 based on the vertical positioning of the ventilation applicator 300 relative to the container 210. In at least one aspect, the ventilation hole 336 is positioned toward the bottom of the container. In an alternative aspect, the ventilation hole 336 is positioned toward the middle of the container. In yet another alternative aspect, the ventilation hole 336 is positioned toward the top of the container.

Figure 6:
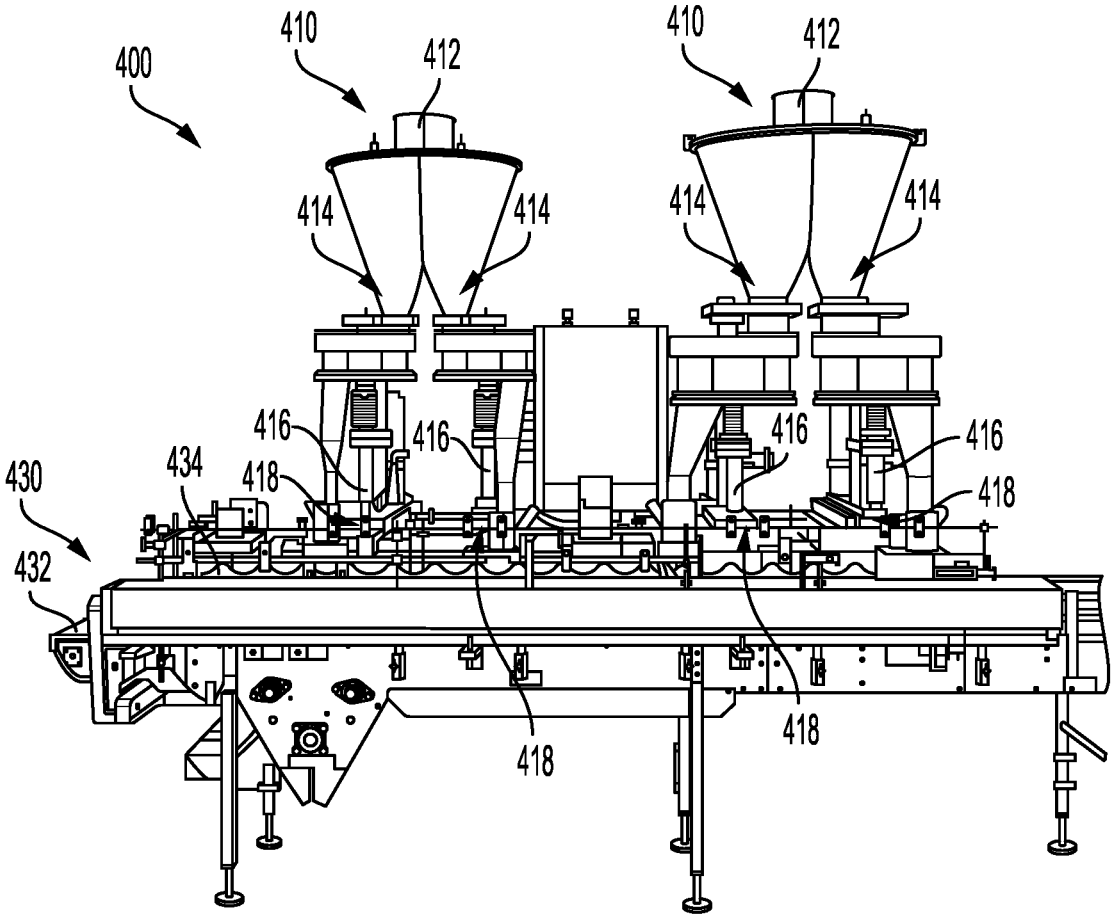
FIG. 6 illustrates an example dry material filling system, according to at least one aspect of the present disclosure.

FIG. 6 illustrates an example dry material filling system 400, according to at least one aspect of the present disclosure. The filling system 400 is configured to place a dry material into a container (e.g. container 210) from a dry material supply 410. The filling system 400 has two dry material supplies 410 that can hold a dry material. The dry material enters the dry material supply 410 at an input 412. Each dry material supply 410 funnels the dry material out of two outputs 414. In at least one aspect, an auguring system pushes the dry material to the outputs 414. Each of the four outputs 414 are coupled to a different tube 416 and each tube has an output 418. The containers are positioned below and adjacent to the outputs 418 to fill the container with a dry material.

The containers (e.g. container 210) are moved through the filling system 400 by a conveyor system 430. The conveyor system 430 includes a conveyor belt 432, side rails, and a side walls 434. The filling system 400 can fill four containers at a time. The conveyor system 430 moves containers on the conveyor belt to below the outputs 418. In at least one aspect, the side walls 434 move toward each other to clamp onto the containers. The side walls 434 then moved the containers up toward the outputs 418 until the containers are adjacent the outputs 418. The filling system 400 then dispenses the dry material into the container. In one aspect, a tube is input into the container as discussed in regard to FIGS. 7A-7C. In an alternative aspect, the filling system 400 dispenses the dry material into the container with the container being coupled to the output 418 and without inserting anything into the container. Once the container is filled, the side walls 434 move the container down to the conveyor belt 432 and the conveyor belt moves the containers down the line toward the next system.

As shown in FIG. 18, in at least one aspect, the filling system 400 can include a filling system control circuit 1830 comprising at least one of a memory 1832, a processor 1834, and a sensor 1836. In at least one aspect, the filling system 400 can determine that the container is filled based on weight of the container sensed by the sensor 1836. In an alternative aspect, sensor 1836 can be a proximity sensor used to determine whether the container is filled based on an amount of material in the container. In yet another alternative aspect, the sensor 1836 can be used to determine whether the container is filled based on an amount of dry material that is dispensed into the container.

In at least one aspect, the containers 210 enter the conveyor 430 from the conveyor system of the system (e.g. depalletizer 200 or ventilation applicator 300) before the filling system 400. The system positioned before the filling system 400 is based on the method 10, 800, 900, or 1000 being performed. For example, the conveyors of each system are coupled together and adjacent to each other such that the containers 210 can move from one system to the next.

In at least one aspect, the filling system 400 is one example of a standard dry material filling system for filling a container with a dry material. Any other dry material filling system can be used in place of the filling system 400. For example, the reader will readily appreciate that there are a number of dry material filling system that are commonly known that can be used to fill a container with a dry material.

Figure 7A:
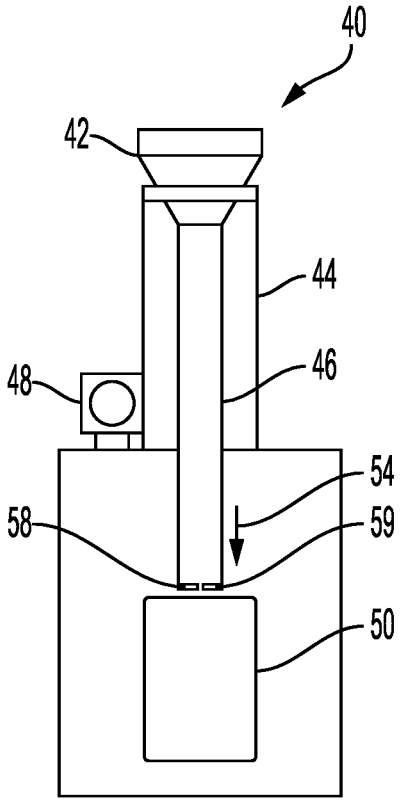
FIGS. 7A-C illustrate a schematic of an example fill process for a dry material, according to at least one aspect of the present disclosure.
Figure 7B:
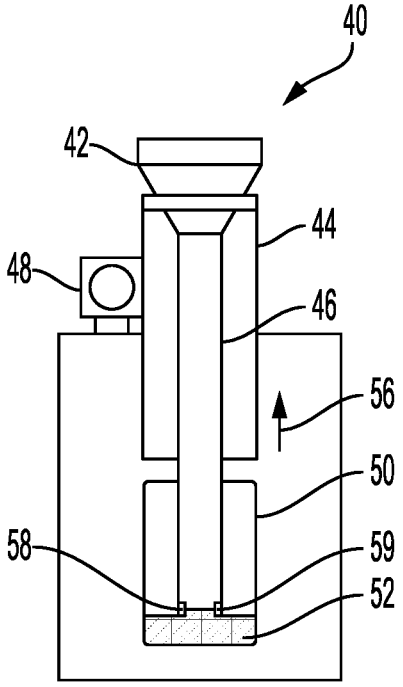
Figure 7C:
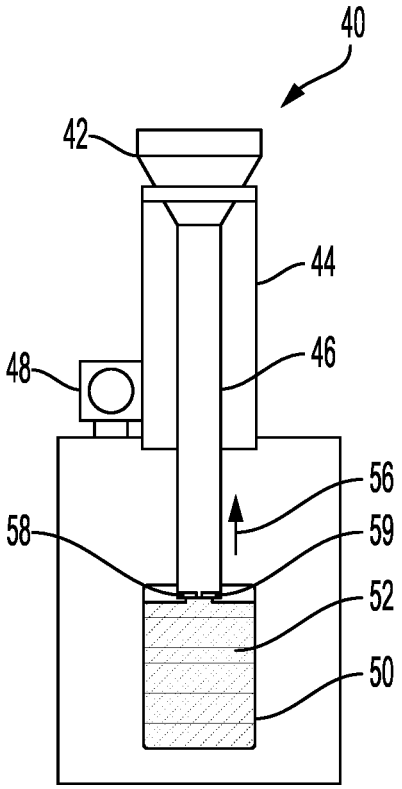

FIGS. 7A-C illustrate a schematic of an example fill process for a dry material, according to at least one aspect of the present disclosure. A conveyor system may place a container 50 below and substantially coaxial with a fill tube 46. In at least one aspect, the container 50 is substantially similar to container 210. Once the container 50 is below the fill tube 46, a motor 48 may lower a frame 44 in direction 54, which lowers the fill tube 46 into the container 50. The motor 48 may stop lowering the frame 44 once the fill tube 46 has reached a predetermined distance within the container 50. In some aspects, the container is moved toward the fill tube 46 with the fill tube remaining in one position. The hopper 42 contains the dry material 52, for example wood chips or pellets. Referring to FIG. 7B, once the fill tube stops moving in direction 54 the plates 58, 59 may rotate to open the fill tube 46 to allow the dry material 52 to begin dispensing into the container 50 from the hopper 42 through the fill tub 46. Once the dry material 52 begins dispensing into the container 50 the motor 48 may begin moving the frame 44 in direction 56. Referring to FIG. 7C, once the fill tube 46 has reached a predetermined distance inside the container 50 the plates 58, 59 rotate to close the fill tube 48. The motor 48 continues to move the frame 44 in direction 56 until the frame 44 has reached the start position shown in FIG. 7A. The conveyor system may then move the container 50 to the next system in the line.

Referring to FIG. 18, the filling system control circuit 1830 may control the fill process. For example, the filling system control circuit 1830 can receive a signal from the sensor 1836 when the sensor 1836 detects that the container 50 has been positioned below the fill tube 46. The processor 1834 can then execute instructions stored in the memory 1832 to begin filling the container. Once the container has been filled, as detected by a sensor, the processor 1834 can stop the filling process. The filling system control circuit 1830 may then communicate with a central control circuit or a separate system control circuit, such as the transport system control circuit 1870, to automate the next step in the method. For example, upon filling the container 50, the filling system control circuit 1830 may communicate with the transport system control circuit 1870 to move the containers 210 to the next process system.

Figure 8:
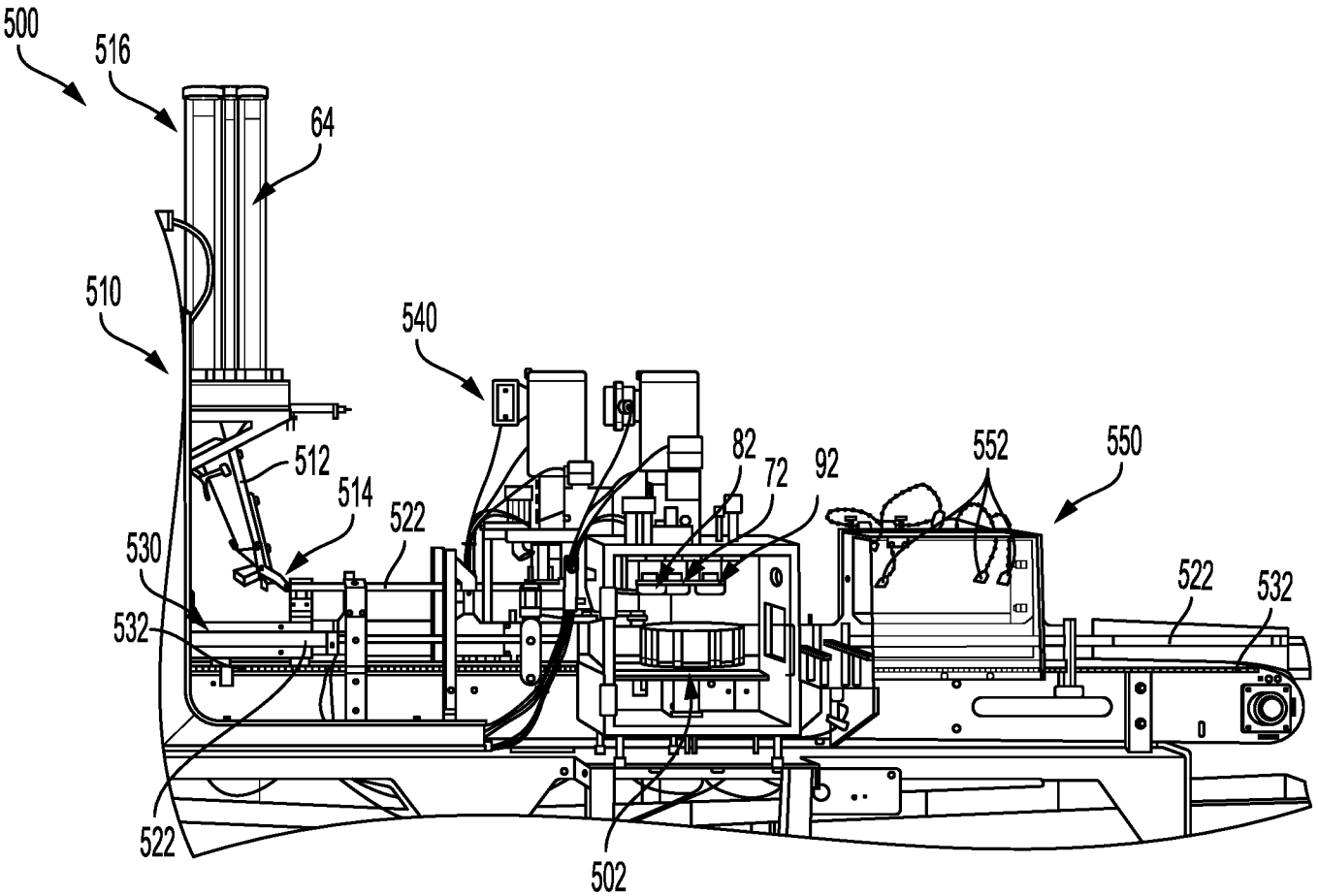
FIG. 8 illustrates an example sealing system, according to at least one aspect of the present disclosure.

FIG. 8 illustrates an example sealing system 500, according to at least one aspect of the present disclosure. The sealing system 500 includes a lid dispenser 510, a sealing mechanism 540, a cleaning system 550, and a conveyor system 530. The containers (e.g. container 210) enter the sealing system 500 on the conveyor system 530. The containers first have a lid 64 placed on the container by the lid dispensing system 500, the lid 64 is sealed on the container by the sealing mechanism 540, and then the sealed container is cleaned by the cleaning system 550.

The conveyor system 530 includes a conveyor belt 530, side rails 522, and a container gripper 502. The containers rest on the conveyor belt 532 and the conveyor belt 532 moves the containers through the sealing system 500. The side rails 522 help keep the containers upright and on the conveyor belt 532. A lid 64 is dispensed onto each container by the lid dispenser 510 as the container moves past the output 514 of the lid dispenser 510. Lids 64 are loaded into a lid supply 516. The lids 64 move down a shaft 512 to an output 514. As a container passes below the output 514 a lid 64 is dispensed onto the container. In at least one aspect, the lid 64 is an easy open lid with a stay on tab such as those seen on soda or beer cans.

Once a lid 64 is place on the container, the container is moved into the sealing mechanism 540 by the conveyor belt 532. The sealing mechanism 540 includes a chuck 72, a die 82 and a die 92. The sealing mechanism double seam seals the lid 64 to the container as discussed in regard to FIGS. 9-10C. In at least one aspect, the conveyor belt 530 moves the container onto a container gripper 502. The container gripper 502 moves the container up to the chuck 72. In an alternative aspect, the chuck 72 is moved toward the container and the container is not raised. Once the chuck is against the lid 64, the die 82 and the die 92 are used to double seam seal the lid to the container as discussed in regard to FIGS. 10A-10C.

As shown in FIG. 18, in at least one aspect, the sealing system 500 can include a sealing system control circuit 1840 comprising at least one of a memory 1842, a processor 1844, and a sensor 1846. The sensor 1846 can measure data indicative of the position of the container 210, the lids 64, container gripper 502, and/or chuck 72. In various other aspects, the sensor 1846 can measure a parameter of the sealing process. The sensor 1846 may comprise proximity sensor, a force sensor, a pressure sensor, or a switch, for example. The sealing system control circuit 1840 can receive a signal from the sensor 1846 and may detect when the container 210 has been gripped, when a lid 64 has been placed on the container, and/or whether the lid 64 has been sealed to the container 210. The processor 1844 may execute instructions stored in the memory 1842 upon the receipt of the signal from the sensor 1846. Once the lid 64 has been sealed on the container 210, the sealing system control circuit 1840 may communicate with a central control circuit or a separate system control circuit, such as the transport system control circuit 1870, to automate the next step in the method. For example, once the lid 64 has been sealed to the container 210, the sealing system control circuit 1840 can communicate with the transport system control circuit 1870 to activate the conveyor system 530 and move the containers 210 to the next process system.

Figure 9:
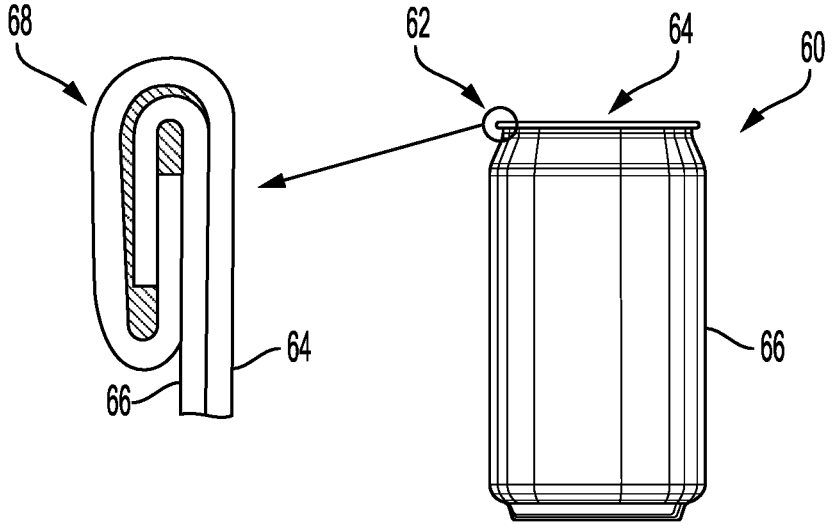
FIG. 9 is a cross-sectional view of a double seam seal, according to at least one aspect of the present disclosure.
Figure 10A:
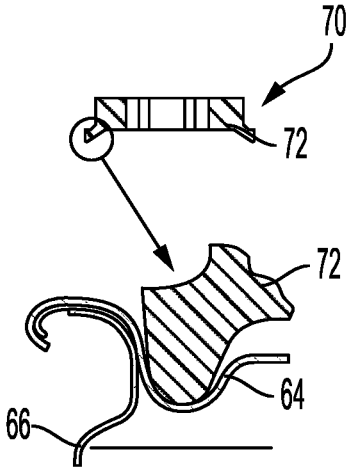
FIGS. 10A-C are sectional views of successive steps to create the double seam seal of FIG. 9, according to at least one aspect of the present disclosure.
Figure 10B:
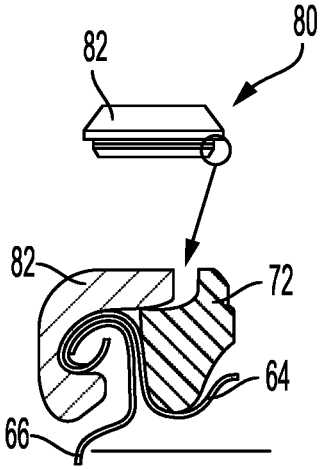
Figure 10C:
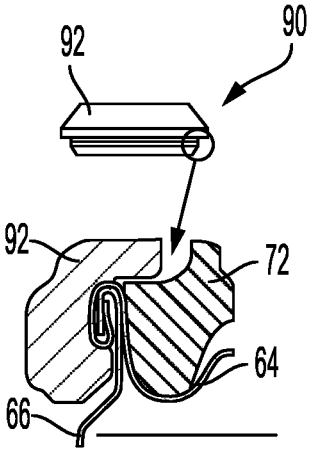

FIG. 9 is a cross-sectional view of a double seam seal, according to at least one aspect of the present disclosure. FIG. 9 shows a non-limiting example of a container 60 with a lid 64 double seam sealed to the side wall 66 of the container 60. In at least one aspect, the container 60 is substantially similar to the container 60. A cross-section 68 is shown for the double seam seal at location 62. At the central portion, the seam is five layers of metal with three layers of lid 64 and two of sidewall 66. FIGS. 10A-C show a non-limiting example of the processes that can be used to form a double seam seal. In at least one aspect, the beginning of the process is to place a lid 64 on top of the filled container. Referring to FIG. 10A, process 70 has a seaming chuck 72 press down on a lid 64 of the container to hold the lid 64 in place. Referring to FIG. 10B, process 80 has die 82 press a predetermined distance against the side of the lid 64 and sidewall 66 to begin curling the lid 64 and sidewall 66 to form partially the double seam seal. Then the die 82 may rotate around the container to form the partial double seam seal around the entire container. In an alternative aspect, the die 82 may remain stationary and the container can rotate. Referring to FIG. 10C, process 90 has die 92 press a predetermined distance against the side of the lid 64 and sidewall 66 to begin curling the lid 64 and sidewall 66 to form the double seam seal. Then the die 92 may rotate around the container to form the double seam seal around the entire container. In an alternative aspect, the die 92 may remain stationary and the container can rotate. After process 92 the container has the double seam seal shown in FIG. 9. Other processes are envisioned that use different standard processes well known in the art to form a seam seal on the container as shown in FIG. 9.

Once the lid 64 is double seam sealed to the container, the container is moved to the cleaning system 550. The cleaning system 550 includes nozzles 552. As a container is moved through the cleaning system 550, the container is sprayed with a liquid from a nozzle 552. For example, the cleaning system 500 can include a sensor that detects when a container is within range of a nozzle 552. Once a container is within range, the nozzle can spray the liquid onto the container. For example, a control circuit can determine based on the sensor reading that the container is within range. In at least one aspect, the liquid is water.

In at least one aspect, the sealing system 500 is one example of a standard sealing system for sealing a lid on a container. Any other sealing system can be used in place of the sealing system 500. For example, the reader will readily appreciate that there are a number of sealing systems that are commonly known that can be used to seal a container with a lid.

In at least one aspect, the containers enter the conveyor system 530 from the conveyor system of the system (e.g. ventilation applicator 300 or filling system 400) before the sealing system 500. The system positioned before the sealing system 500 is based on the method 10, 800, 900, or 1000 being performed. For example, the conveyors of each system are coupled together and adjacent to each other such that the containers 210 can move from one system to the next.

Figure 11:
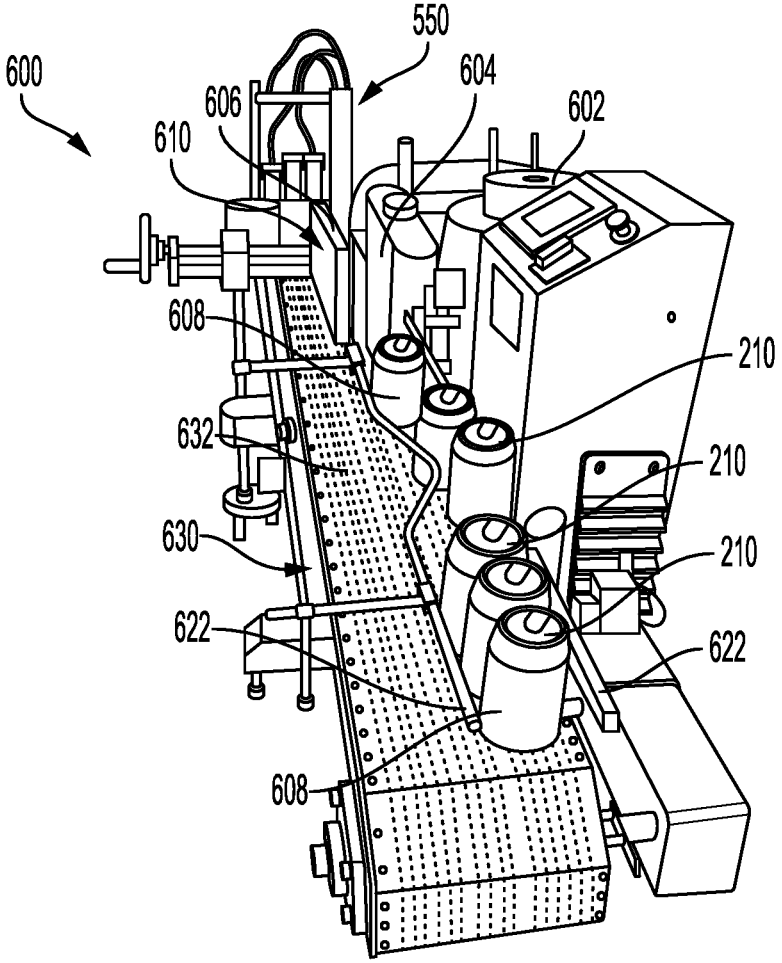
FIG. 11 illustrates an example labeling system, according to at least one aspect of the present disclosure.

FIG. 11 illustrates an example labeling system 600, according to at least one aspect of the present disclosure. The labelling system 600 includes a conveyor system 630 and a label applicator 610. The conveyor system 630 includes a conveyor belt 632 and side rails 622. The containers 210 enter the labeling system 600 on a conveyor system 630. The containers 210 rest on the conveyor belt 632 and the conveyor belt 632 moves the containers 210 through the labeling system 600. The side rails 622 help keep the containers 210 upright and on the conveyor belt 632. The conveyor belt 632 moves a container 210 into the label applicator 610.

The label applicator 610 includes a media supply 602, a first side wall 604 and a second side wall 606. The conveyor 632 moves the container 210 between the first side wall 604 and the second side wall 606. The side wall 604 includes a belt that wraps around the side wall 604 in the same direction as the conveyor belt 632. The belt is moved around the side wall 604 in the same direction as the conveyor belt 632. The side wall 606 includes a belt that wraps around the side wall 606 in the same direction as the conveyor belt 632. The belt is moved around the side wall 606 in the opposite direction as the conveyor belt 632. As the container is moved between the side walls 604 and 606, the belts on the side walls 604 and 606 cause the container 210 to rotate. A label 608 from the media supply 602 is wrapped around the container 210 as the container is rotated between the side walls 604 and 606. For example, the beginning of a label 610 can be attached to the container as the container enters the side walls 604 and 606 and the rotation of the container 210 wraps the label 608 around the container 210. In at least one aspect, the label 608 has an adhesive back that sticks to the container 210. In various aspects, the media supply 602 comprises a pre-printed roll of labels. The container 210 exits the side walls 604 and 606 with a label 608 attached to the container.

As shown in FIG. 18, in at least one aspect, the labeling system 600 can include a labeling system control circuit 1850 comprising at least one of a memory 1852, a processor 1854, and a sensor 1856. The sensor 1856 can measure data indicative of the position of the containers 210 relative to the label applicator 610. In various other aspects, the sensor 1856 can measure parameters of the label applicator 610, such as the speed of the application of the label 608 or the pressure applied by the label applicator 610. The sensor 1856 may comprise proximity sensor, a force sensor, or a switch, for example. The labeling system control circuit 1850 can receive a signal from the sensor 1856 and can detect when a container 210 is positioned to receive a label 608 and/or whether a label 608 has been applied to a container 210. The processor 1854 may execute instructions stored in the memory 1852 upon the receipt of the signal from the sensor 1856. Upon execution of the instructions, the labelling system control circuit 1850 may communicate with a central control circuit or a separate system control circuit, such as the transport system control circuit 1870, to automate the next step in the method. For example, once a label 608 has been applied to the container 210, the labeling system control circuit 1850 can communicate with the transport system control circuit 1870 to activate the conveyer 632 to move the containers 210 to the next process system.

In at least one aspect, the labeling system 600 is one example of a standard labeling system for placing a label on a container. Any other labeling system can be used in place of the labelling system 600. For example, the reader will readily appreciate that there are a number of labeling systems that are commonly known that can be used to place a label on a container.

In at least one aspect, the containers enter the conveyor system 630 from the conveyor system of the system (e.g. ventilation applicator 300 or sealing system 400) before the labeling system 600. The system positioned before the labeling system 600 is based on the method 10, 800, 900, or 1000 being performed. For example, the conveyors of each system are coupled together and adjacent to each other such that the containers 210 can move from one system to the next.

Figure 12:
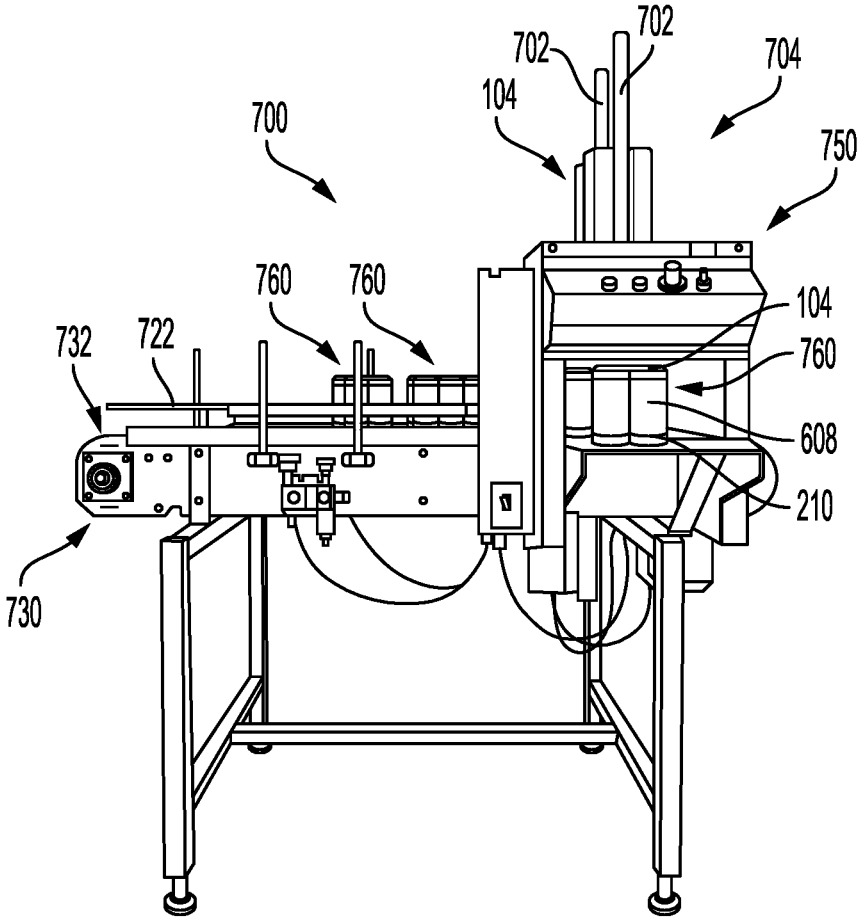
FIG. 12 illustrates an example packaging system, according to at least one aspect of the present disclosure.

FIG. 12 illustrates an example packaging system 700, according to at least one aspect of the present disclosure. After container is filled, sealed, and labeled, the container is moved to the packaging system 700. The packaging system 700 includes a carrier applicator 750 and a conveyor system 730. The conveyor system 730 includes a conveyor belt 732 and side rails 722. The containers 210 enter the packing system 700 on a conveyor belt and are moved into the carrier applicator 750. In some aspects, a conveyor system positions the containers 210 into a group to be packaged before the containers 210 reach the packing system 700. The carrier applicator 750 places a carrier 104 over the containers 210. In one aspect, the carrier 104 is attached to the containers 210 to hold the containers 210 together. In an alternative aspect, the carrier 104 is wrapped around the containers 210 to hold the containers 210 together. The packaging system 700 can package the containers to be sold individually or sold with multiple containers 210 in the carrier 104, for example 4 packs, 6 packs, 8 packs, etc. The carrier applicator 750 includes a carrier supply 704. The carrier supply 704 includes guide rods 702 where carriers are slid down the guide rods 702 and into the carrier applicator 750.

As shown in FIG. 18, the packaging system 700 can include a packaging system control circuit 1860 comprising at least one of a memory 1862, a processor 1864, and a sensor 1866. The sensor 1866 can measure data indicative of the position of the containers 210 in the carrier applicator 750. The packaging system control circuit 1860 can detect when the containers 210 are in position to apply a carrier to the containers 210 based on the sensor data. Once the containers 210 are in position, the carrier applicator 750 can attach a carrier 104 to the containers forming a packaged containers 760 that can be sold. The containers 210 are position within the carrier applicator 750 by a conveyor. The packaged containers 760 move out of the carrier applicator 750 and onto a conveyor belt 732. The packaged containers 760 may then be loaded onto a pallet or other system for distribution for selling or storage of the packaged containers 760.

Figure 13:
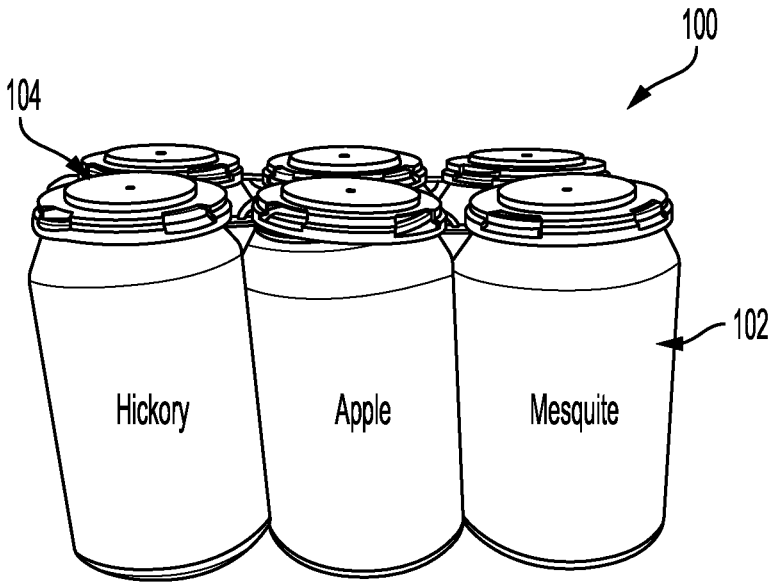
FIG. 13 is a view of an example of packaged containers, according to at least one aspect of the present disclosure.

In one aspect, the packaging system 700 may package containers 210 together that are filled with different dry materials, such as different smoke fuels. FIG. 13 is a view of an example of packaged containers 100, according to at least one aspect of the present disclosure. FIG. 13 shows a 6-pack 100 of smoke containers 102. In at least one aspect, the smoke containers 102 are substantially similar to containers 210. Each of the smoke containers 102 may have a different smoke fuel in them. FIG. 13 shows smoke containers 102 with smoke fuel of hickory, apple, and mesquite. The smoke containers 102 are held together with a carrier 104.

Figure 14:
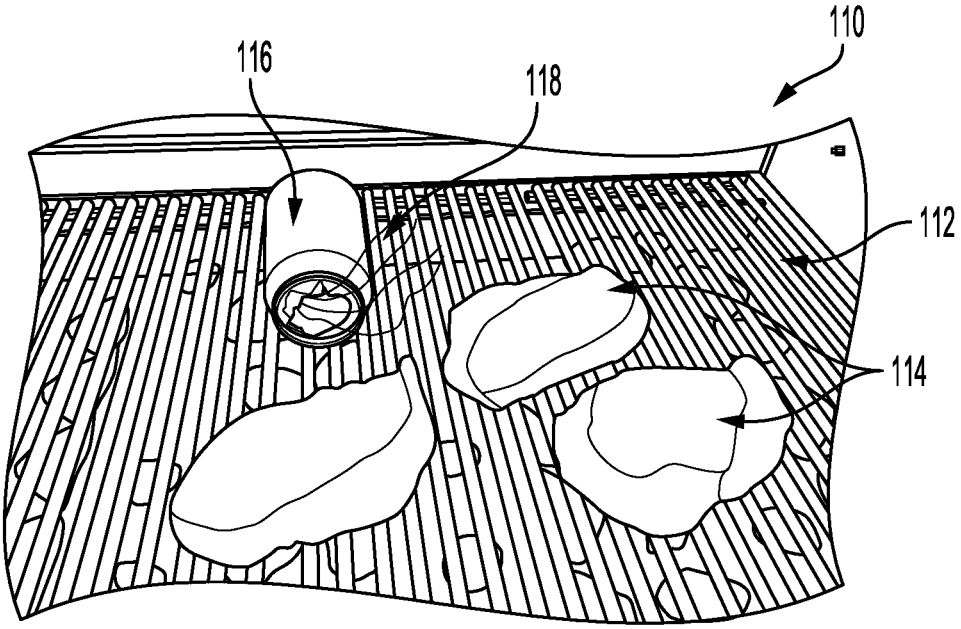
FIG. 14 is a view of the container being used in a grill, according to at least one aspect of the present disclosure.

FIG. 14 is a view of the container 116 being used in a grill 110, according to at least one aspect of the present disclosure. A conventional grill 110 is used with the smoke container 116. In at least one aspect, the smoke container 116 is substantially similar to container 210. The smoke container 116 is opened on the side with the easy open lid with a stay on tab. In at least one aspect, on the side of the smoke container 116, a small hole is punched with a knife or some other such tool. In an alternative aspect, the vent hole is already in the container 116, where the vent hold was added by the ventilation application 300 during the creation of the smoke container 116. In at least one aspect, the label 608 is removed from the smoke container 116 prior to placing the container 116 inside of the conventional grill 110. The smoke container 116 is laid on its side on a grill grate 112 inside of the conventional grill 110. As the conventional grill heats, the smoke container 116 will heat and begin to smoke 118 once the smoke container 116 becomes hot enough usually over 350° F. An example standard temperature for the smoke container 116 to begin emitting smoke 118 is 400° F. The food 114 to be cooked on the grill grate 112 is placed near the smoke container 116 and the lid of the conventional grill 110 is closed. As the food 114 cooks in the conventional grill 110 the smoke 118 flavors the food 114. After the food 114 is cooked the smoke container 116 can be left on the conventional grill 110 to cool. Once the smoke container 116 has cooled, it can be disposed of appropriately. Multiple cans can be used to impart a stronger smoke flavor.

It will be appreciated that the scope of the present includes any containers 50 that may receive or be filled with any dry material 52, such as a smoke fuel 52. Accordingly, the scope of the present disclosure includes methods where containers 50 are filled with a smoke fuel 52 and/or any dry non-liquid materials from a dry material supply, as shown in FIGS. 6-7C, to create a smoke container (e.g. container 210). The dry non-liquid material may be in pellet form.

Figure 15:
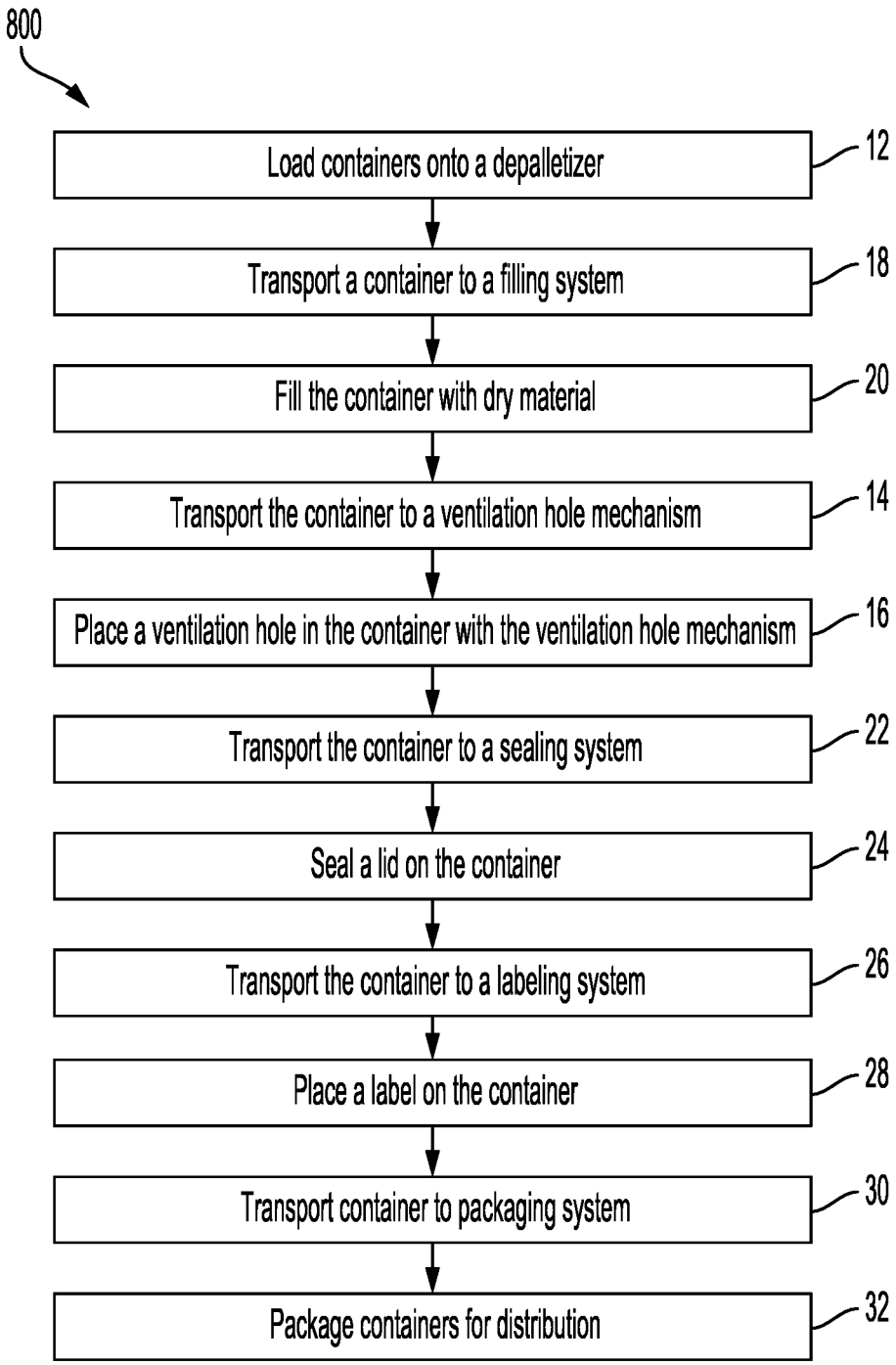
FIG. 15 illustrates an example method to fill a container with a dry material and package it, according to at least one aspect of the present disclosure.

FIG. 15 illustrates an example method to fill a container with a dry material and package it, according to at least one aspect of the present disclosure. The method 800 is substantially similar to the method 10 and the similarities will not be discussed in detail for the sake of brevity. The same operations are performed to fill the container (e.g. container 210) but the order of the operations is different. For example, the method 800 depalletizes a container, fills the container, places a ventilation hole in the container, seals the container, labels the container, and then packages the container.

Figure 16:
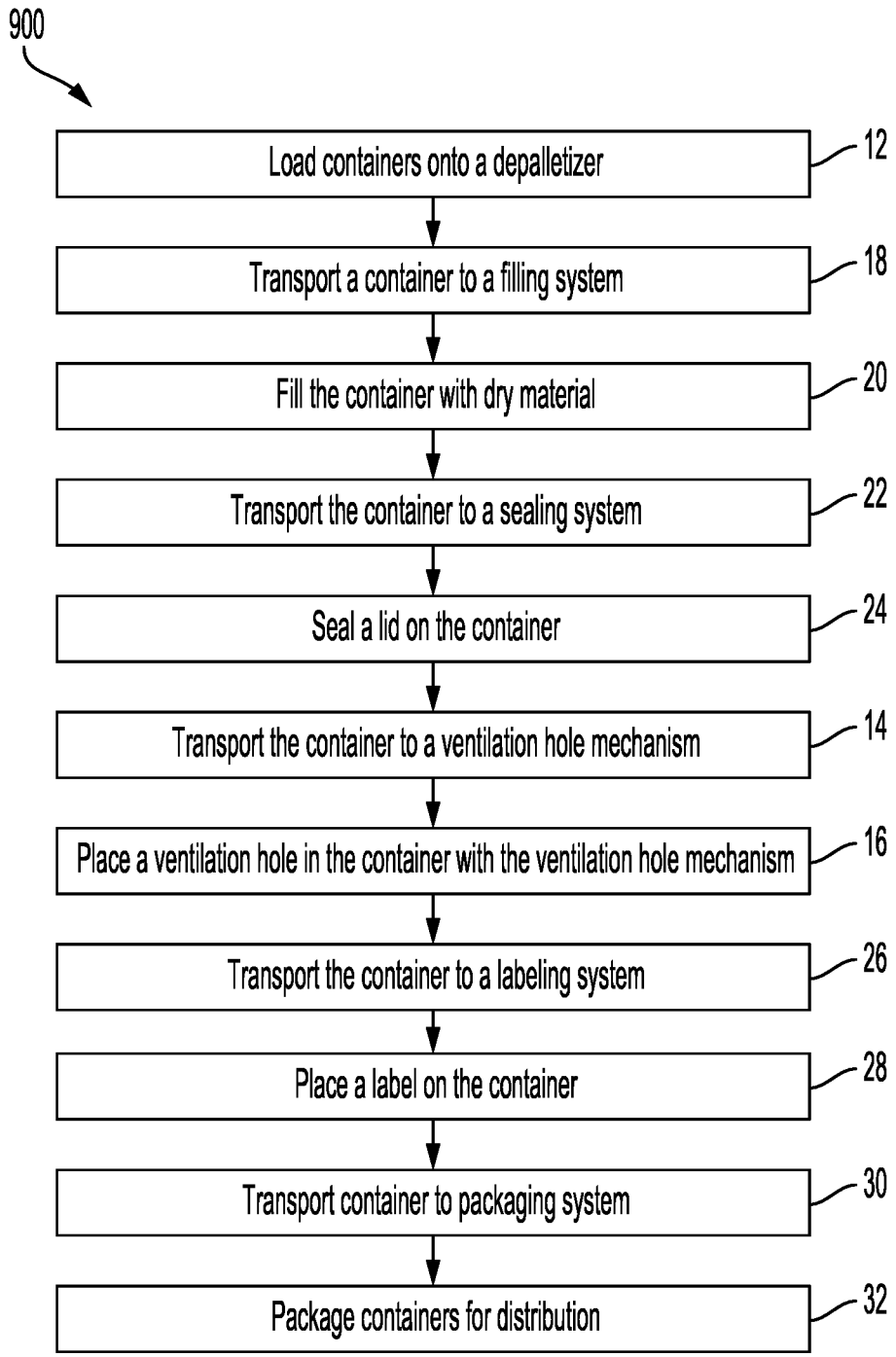
FIG. 16 illustrates an example method to fill a container with a dry material and package it, according to at least one aspect of the present disclosure.

FIG. 16 illustrates an example method to fill a container with a dry material and package it, according to at least one aspect of the present disclosure. The method 900 is substantially similar to the method 10 and the similarities will not be discussed in detail for the sake of brevity. The same operations are performed to fill the container (e.g. container 210) but the order of the operations is different. For example, the method 900 depalletizes a container, fills the container, seals the container, places a ventilation hole in the container, labels the container, and then packages the container.

Figure 17:
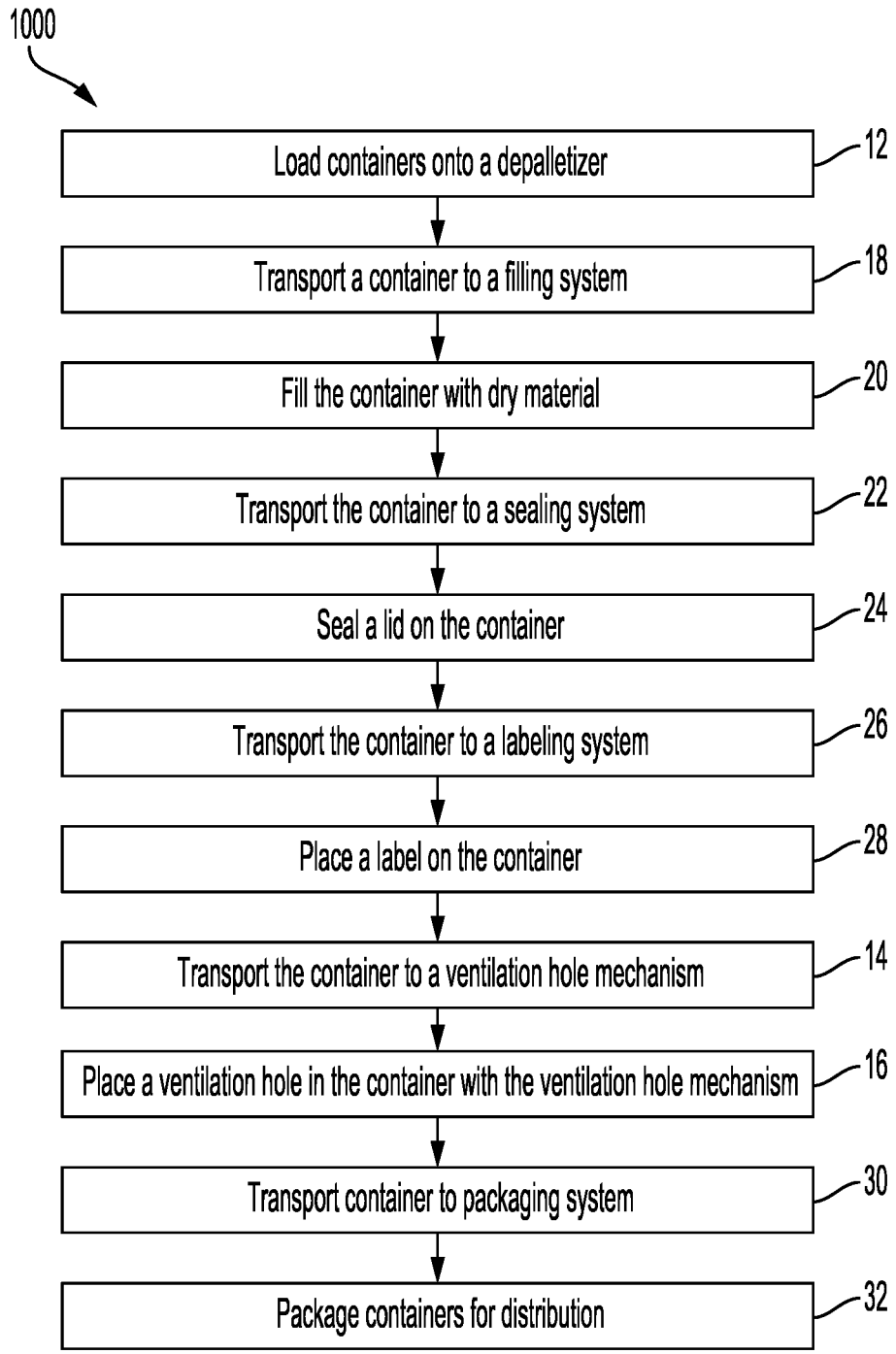
FIG. 17 illustrates an example method to fill a container with a dry material and package it, according to at least one aspect of the present disclosure.

FIG. 17 illustrates an example method to fill a container with a dry material and package it, according to at least one aspect of the present disclosure. The method 1000 is substantially similar to the method 10 and the similarities will not be discussed in detail for the sake of brevity. The same operations are performed to fill the container (e.g. container 210) but the order of the operations is different. For example, the method 1000 depalletizes a container, fills the container, seals the container, labels the container, places a ventilation hole in the container, and then packages the container.

In at least one aspect, the conveyor systems 220, 325, 430, 530, 630, and 730 are all the same conveyor system. In an alternative aspect, each system has a separate conveyor system 220, 325, 430, 530, 630, and 730 that are positioned against each other to allow the containers to move from one conveyor system to the next conveyor system.

As shown in FIG. 18, in at least one aspect, the conveyor systems 220, 325, 430, 530, 630, and 730 can be controlled by a transport system control circuit 1870 comprising at least one of a memory 1872, a processor 1874, and a sensor 1876. The sensor 1816 can measure data indicative of the position of the container 210 on the conveyor systems 220, 325, 430, 530, 630, and 730. The sensor 1876 may comprise proximity sensor or a switch, for example. The transport system control circuit 1870 can receive a signal from the sensor 1816 and detect the location of one or more containers 210 on the conveyer system 200. The processor 1874 may execute instructions stored in the memory 1872 upon the receipt of the signal from the sensor 1876.

EXAMPLES

Various aspects of the subject matter described herein are set out in the following numbered examples.

Example 1—A method to fill and seal a container for smoking food on a grill. The method includes positioning a container on a conveyor system, receiving the container in a vent hole applicator system, and placing a vent hole in the container with the vent hole applicator system. The method further includes receiving the container in a filling system, positioning the container adjacent to a tube from the filling system, and dispensing a smoke fuel from a hopper into the container through the tube. The method further includes receiving the container in a seam sealing system, positioning a lid onto the container, and curling the lid and container top to form a double seam. The method further includes receiving the container in a packaging system and packaging the container into sale packs for distribution.

Example 2—The method of Example 1, further includes receiving the container in a labeling system and applying a label to the container.

Example 3—The method of Examples 1 or 2, wherein the conveyor system moves the container to the vent hole system, the filling system, the sealing system, and the packaging system.

Example 4—The method of Examples 1, 2, or 3, wherein the vent hole is placed before the container is filled with a smoke fuel.

Example 5—The method of Examples 1, 2, or 3, wherein the vent hole is placed after the container is filled with a smoke fuel.

Example 6—The method of Examples 1, 2, 3, 4, or 5, wherein the container is cylindrical.

Example 7—The method of Examples 1, 2, 3, 4, 5, or 6, wherein the container holds equal to or greater than 12 oz.

Example 8—The method of Examples 1, 2, 3, 4, 5, 6, or 7, wherein the smoke fuel is wood chips.

Example 9—The method of Example 1, 2, 3, 4, 5, 6, 7, or 8, wherein the smoke fuel is wood pellets.

Example 10—A method to fill and seal a container. The method includes positioning a container on a conveyor system, receiving the container in a vent hole applicator system, and placing a vent hole in the container with the vent hole applicator system. The method further includes receiving the container in a filling system, positioning the container adjacent to a tube from the filling system, and dispensing a dry material from a hopper into the container through the tube. The method further includes receiving the container in a seam sealing system, positioning a lid onto the container, and curling the lid and container top to form a double seam. The method further includes receiving the container in a packaging system, and packaging the container into sale packs for distribution.

Example 11—The method of Example 10, further including receiving the container in a labeling system and applying a label to the container.

Example 12—The method of Examples 10 or 11, wherein the conveyor system moves the container to the vent hole system, the filling system, the sealing system, and the packaging system.

Example 13—The method of Examples 10, 11, or 12, wherein the vent hole is placed before the container is filled with a smoke fuel.

Example 14—The method of Examples 10, 11, or 12, wherein the vent hole is placed after the container is filled with a smoke fuel.

Example 15—The method of Examples 10, 11, 12, 13, or 14, wherein the dry material includes any non-liquid material.

Example 16—The method of Examples 10, 11, 12, 13, 14, or 15, wherein the dry material is in pellet form.

Example 17—The method of Examples 10, 11, 12, 13, 14, 15, or 16, wherein the dry material comprises baker's yeast, dehydrated bouillon, freeze-dried goods, dried fruit, powdered food, instant coffee, coffee beans, coffee grounds, spices, oatmeal, soup stock, seeds, beans, grain, dried meat, dried seafood, candy, or a combination thereof.

Example 18—The method of Examples 10, 11, 12, 13, 14, 15, or 16, wherein the dry material comprises a *cannabis* product, a tobacco product, or a combination thereof.

Example 19—The method of Example 10, 11, 12, 13, 14, 15, 16, or 18, wherein the dry material comprises a powder, granules, pellets, briquettes, pills, tablets, capsules, beads, or a combination thereof.

While several forms have been illustrated and described, it is not the intention of Applicant to restrict or limit the scope of the appended claims to such detail. Numerous modifications, variations, changes, substitutions, combinations, and equivalents to those forms may be implemented and will occur to those skilled in the art without departing from the scope of the present disclosure. Moreover, the structure of each element associated with the described forms can be alternatively described as a means for providing the function performed by the element. Also, where materials are disclosed for certain components, other materials may be used. It is therefore to be understood that the foregoing description and the appended claims are intended to cover all such modifications, combinations, and variations as falling within the scope of the disclosed forms. The appended claims are intended to cover all such modifications, variations, changes, substitutions, modifications, and equivalents.

The foregoing detailed description has set forth various forms of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, and/or examples can be implemented, individually and/or collectively, by a wide range of hardware, software, firmware, or virtually any combination thereof. Those skilled in the art will recognize that some aspects of the forms disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as one or more program products in a variety of forms, and that an illustrative form of the subject matter described herein applies regardless of the particular type of signal bearing medium used to actually carry out the distribution.

Instructions used to program logic to perform various disclosed aspects can be stored within a memory in the system, such as dynamic random access memory (DRAM), cache, flash memory, or other storage. Furthermore, the instructions can be distributed via a network or by way of other computer readable media. Thus a machine-readable medium may include any mechanism for storing or transmitting information in a form readable by a machine (e.g., a computer), but is not limited to, floppy diskettes, optical disks, compact disc, read-only memory (CD-ROMs), and magneto-optical disks, read-only memory (ROMs), random access memory (RAM), erasable programmable read-only memory (EPROM), electrically erasable programmable read-only memory (EEPROM), magnetic or optical cards, flash memory, or a tangible, machine-readable storage used in the transmission of information over the Internet via electrical, optical, acoustical or other forms of propagated signals (e.g., carrier waves, infrared signals, digital signals, etc.). Accordingly, the non-transitory computer-readable medium includes any type of tangible machine-readable medium suitable for storing or transmitting electronic instructions or information in a form readable by a machine (e.g., a computer).

As used in any aspect herein, the term "control circuit" may refer to, for example, hardwired circuitry, programmable circuitry (e.g., a computer processor including one or more individual instruction processing cores, processing unit, processor, microcontroller, microcontroller unit, controller, digital signal processor (DSP), programmable logic device (PLD), programmable logic array (PLA), or field programmable gate array (FPGA)), state machine circuitry, firmware that stores instructions executed by programmable circuitry, and any combination thereof. The control circuit may collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Accordingly, as used herein "control circuit" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). Those having skill in the art will recognize that the subject matter described herein may be implemented in an analog or digital fashion or some combination thereof.

As used in any aspect herein, the term "logic" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

As used in any aspect herein, the terms "component," "system," "module" and the like can refer to a control circuit computer-related entity, either hardware, a combination of hardware and software, software, or software in execution.

As used in any aspect herein, an "algorithm" refers to a self-consistent sequence of steps leading to a desired result, where a "step" refers to a manipulation of physical quantities and/or logic states which may though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities and/or states.

A network may include a packet switched network. The communication devices may be capable of communicating with each other using a selected packet switched network communications protocol. One example communications protocol may include an Ethernet communications protocol which may be capable permitting communication using a Transmission Control Protocol/Internet Protocol (TCP/IP). The Ethernet protocol may comply or be compatible with the Ethernet standard published by the Institute of Electrical and Electronics Engineers (IEEE) titled "IEEE 802.3 Standard", published in December 2008, and/or later versions of this standard. Alternatively or additionally, the communication devices may be capable of communicating with each other using an X.25 communications protocol. The X.25 communications protocol may comply or be compatible with a standard promulgated by the International Telecommunication Union-Telecommunication Standardization Sector (ITU-T). Alternatively or additionally, the communication devices may be capable of communicating with each other using a frame relay communications protocol. The frame relay communications protocol may comply or be compatible with a standard promulgated by Consultative Committee for International Telegraph and Telephone (CCITT) and/or the American National Standards Institute (ANSI). Alternatively or additionally, the transceivers may be capable of communicating with each other using an Asynchronous Transfer Mode (ATM) communications protocol. The ATM communications protocol may comply or be compatible with an ATM standard published by the ATM Forum titled "ATM-MPLS Network Interworking 2.0" published August 2001, and/or later versions of this standard. Of course, different and/or after-developed connection-oriented network communication protocols are equally contemplated herein.

Unless specifically stated otherwise as apparent from the foregoing disclosure, it is appreciated that, throughout the foregoing disclosure, discussions using terms such as "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

It will be appreciated that, for convenience and clarity, spatial terms such as "vertical", "horizontal", "up", and "down" may be used herein with respect to the drawings.

Those skilled in the art will recognize that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flow diagrams are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

It is worthy to note that any reference to "one aspect," "an aspect," "an exemplification," "one exemplification," and the like means that a particular feature, structure, or characteristic described in connection with the aspect is included in at least one aspect. Thus, appearances of the phrases "in one aspect," "in an aspect," "in an exemplification," and "in one exemplification" in various places throughout the specification are not necessarily all referring to the same aspect. Furthermore, the particular features, structures or characteristics may be combined in any suitable manner in one or more aspects.

Any patent application, patent, non-patent publication, or other disclosure material referred to in this specification and/or listed in any Application Data Sheet is incorporated by reference herein, to the extent that the incorporated materials is not inconsistent herewith. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

In summary, numerous benefits have been described which result from employing the concepts described herein. The foregoing description of the one or more forms has been presented for purposes of illustration and description. It is not intended to be exhaustive or limiting to the precise form disclosed. Modifications or variations are possible in light of the above teachings. The one or more forms were chosen and described in order to illustrate principles and practical application to thereby enable one of ordinary skill in the art to utilize the various forms and with various modifications as are suited to the particular use contemplated. It is intended that the claims submitted herewith define the overall scope.

The invention claimed is:

1. A method to fill and seal a container for smoking food on a grill, the method comprising:

positioning a container on a conveyor system;

receiving the container in a vent hole applicator system, the vent hole applicator system comprising a plurality of hole applicators and a housing having a plurality of concave pockets positioned circumferentially along a surface of the housing;

placing a vent hole in the container with a hole applicator of the plurality of hole applicators while the container is received by a pocket of the plurality of pockets;

receiving the container in a filling system;

positioning the container adjacent to a tube from the filling system;

dispensing a smoke fuel from a hopper into the container through the tube;

receiving the container in a seam sealing system;

positioning a lid onto the container;

curling the lid and container top to form a double seam;

receiving the container in a packaging system; and packaging the container into sale packs for distribution.

2. The method of claim 1, further comprising:

receiving the container in a labeling system; and applying a label to the container.

3. The method of claim 1, wherein the conveyor system moves the container to the vent hole applicator system, the filling system, the seam sealing system, and the packaging system.

4. The method of claim 1, wherein the vent hole is placed before the container is filled with the smoke fuel.

5. The method of claim 1, wherein the vent hole is placed after the container is filled with the smoke fuel.

6. The method of claim 1, wherein the container is cylindrical.

7. The method of claim 1, wherein the container holds equal to or greater than 12 oz.

8. The method of claim 1, wherein the smoke fuel is wood chips.

9. The method of claim 1, wherein the smoke fuel is wood pellets.

10. A method to fill and seal a container, the method comprising:

positioning a container on a conveyor system;

receiving the container in a vent hole applicator system, the vent hole applicator system comprising a plurality of hole applicators and a housing having a plurality of concave pockets positioned circumferentially along a surface of the housing;

placing a vent hole in the container with a hole applicator of the plurality of hole applicators while the container is received by a pocket of the plurality of pockets;

receiving the container in a filling system;

positioning the container adjacent to a tube from the filling system;

dispensing a dry material from a hopper into the container through the tube;

receiving the container in a seam sealing system;

positioning a lid onto the container;

curling the lid and container top to form a double seam;

receiving the container in a packaging system; and packaging the container into sale packs for distribution.

11. The method of claim 10, further comprising:

receiving the container in a labeling system; and applying a label to the container.

12. The method of claim 10, wherein the conveyor system moves the container to the vent hole applicator system, the filling system, the seam sealing system, and the packaging system.

13. The method of claim 10, wherein the vent hole is placed before the container is filled with the dry material.

14. The method of claim 10, wherein the vent hole is placed after the container is filled with the dry material.

15. The method of claim 10, wherein the dry material includes a non-liquid material.

16. The method of claim 10, wherein the dry material is in pellet form.

17. The method of claim 10, wherein the dry material comprises baker's yeast, dehydrated bouillon, freeze-dried goods, dried fruit, powdered food, instant coffee, coffee beans, coffee grounds, spices, oatmeal, soup stock, seeds, beans, grain, dried meat, dried seafood, candy, or a combination thereof.

18. The method of claim 10, wherein the dry material comprises a *cannabis* product, a tobacco product, or a combination thereof.

19. The method of claim 10, wherein the dry material comprises a powder, granules, pellets, briquettes, pills, tablets, capsules, beads, or a combination thereof.

* * * * *